US006829448B2

(12) United States Patent
Ozawa et al.

(10) Patent No.: US 6,829,448 B2
(45) Date of Patent: Dec. 7, 2004

(54) IMAGE FORMING APPARATUS AND IMAGE FORMING METHOD

(75) Inventors: Yoshio Ozawa, Mie (JP); Yuji Kamiyama, Mie (JP); Shoichi Sakata, Mie (JP); Toshinori Nishimura, Mie (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/396,080

(22) Filed: Mar. 25, 2003

(65) Prior Publication Data

US 2004/0022549 A1 Feb. 5, 2004

(30) Foreign Application Priority Data

| | | |
|---|---|---|
| Mar. 26, 2002 | (JP) | 2002-086250 |
| Mar. 28, 2002 | (JP) | 2002-091788 |
| Mar. 28, 2002 | (JP) | 2002-091789 |
| May 24, 2002 | (JP) | 2002-151413 |

(51) Int. Cl.[7] ..... G03G 15/08; G03G 15/09

(52) U.S. Cl. ..... 399/55; 399/267; 399/270; 399/282; 430/122

(58) Field of Search ..... 399/53, 55, 252, 399/265, 267, 270, 272, 273, 279, 281, 282, 285; 430/120, 122

(56) References Cited

U.S. PATENT DOCUMENTS

| | | | | |
|---|---|---|---|---|
| 3,866,574 A | | 2/1975 | Hardennrook et al. | 118/637 |
| 3,929,098 A | | 12/1975 | Leibman | 118/637 |
| 5,341,197 A | | 8/1994 | Folkins et al. | 355/264 |
| 5,420,375 A | | 5/1995 | Folkins et al. | 118/652 |
| 5,832,350 A | * | 11/1998 | Kumasaka et al. | 399/282 |
| 5,953,570 A | * | 9/1999 | Hirai | 399/282 |
| 6,006,048 A | * | 12/1999 | Folkins | 399/55 |
| 6,285,840 B1 | * | 9/2001 | Budnik et al. | 399/55 X |
| 6,445,889 B1 | * | 9/2002 | Leclerc et al. | 399/53 |
| 6,512,909 B2 | * | 1/2003 | Ozawa et al. | 399/270 |
| 6,658,227 B2 | * | 12/2003 | Oyama et al. | 399/267 |
| 2002/0039496 A1 | * | 4/2002 | Aoki et al. | 399/55 |
| 2004/0002015 A1 | * | 1/2004 | Ozaw et al. | 430/122 |

FOREIGN PATENT DOCUMENTS

| | | | |
|---|---|---|---|
| EP | 0772097 A2 | * | 5/1997 |
| JP | 59121077 | | 7/1984 |
| JP | 63249164 | | 10/1988 |
| JP | 3113474 | | 5/1991 |
| JP | 6067546 | | 3/1994 |
| JP | 7072733 | | 3/1995 |
| JP | 7092804 | | 4/1995 |
| JP | 7128983 | | 5/1995 |
| JP | 11231652 | | 8/1999 |
| JP | 2000081788 | | 3/2000 |
| JP | 20000250294 | | 9/2000 |
| JP | 2002-333775 | * | 11/2002 |

* cited by examiner

*Primary Examiner*—Sophia S. Chen
(74) *Attorney, Agent, or Firm*—Schulte Roth & Zabel LLP; Joel E. Lutzker; Mayankkumar Dixit

(57) ABSTRACT

A method and apparatus for image forming includes a hybrid developing apparatus that supplies surly charged toner to a developing roll. The apparatus includes a developing roll that is electrically conductive at least on its surface. The image forming apparatus and the method have a constitution capable of applying an alternating current bias having a duty ratio in the range of 10 to 50% and a direct current bias superposed thereon. The developing roll is directly confronted with a latent image bearing body through an insulative toner thin layer at the nearest region of the developing roll and the latent image bearing body. An independent bias is applied to each of the developing roll and the magnetic roll, and the toner is refreshed by the varying duty ratio of the alternate current bias and the direct current bias after developing.

19 Claims, 8 Drawing Sheets

Fig.3
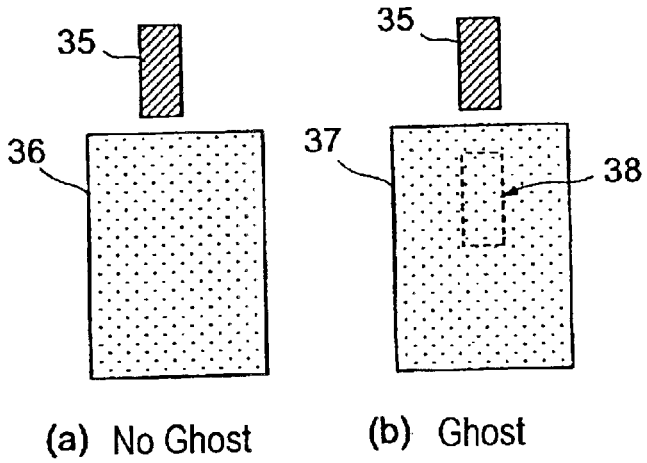
Fig.4
| Volume Resistivity of sleeve ($\Omega \cdot cm^3$) | 1.00E+03 | 1.00E+04 | 1.00E+05 | 1.00E+06 | 1.00E+07 | 1.00E+08 |
|---|---|---|---|---|---|---|
| Image Consistency after printing 10000 sheets (Initial 1.43) | 1.40 | 1.40 | 1.38 | 1.37 | 1.25 | 1.20 |
Vdc1:100V Vdc2:350V AC of 27b :Vpp 1.5Kv f 3.0KHz Duty 30% Waveform: Square Wave
Fig.5
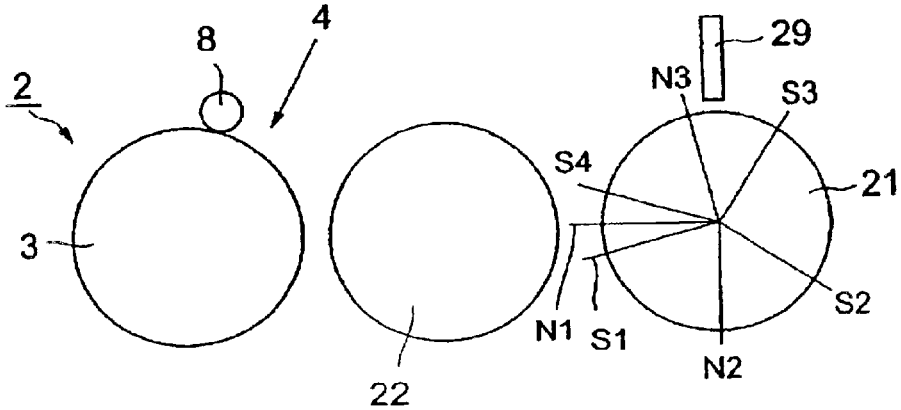

Fig.6

| | | S1 | N1 | S4 | A toner amount corresponding to a number of rotation of the developing roll | | |
|---|---|---|---|---|---|---|---|
| | | | | | 1 (Round) | 2 | 3 |
| Example 1 | Magnetic Force | 500G | 400G | 500G | 1.48 mg/cm$^2$ | 1.52 | 1.52 |
| | Angle from N1 | 30° | 0° | -30° | | | |
| Example 2 | Magnetic Force | 400G | 400G | 400G | 1.39 | 1.45 | 1.46 |
| | Angle from N1 | 30° | 0° | -30° | | | |
| Example 3 | Magnetic Force | 550G | 350G | 450G | 1.45 | 1.48 | 1.50 |
| | Angle from N1 | 30° | 0° | -30° | | | |
| Comparative Example 4 | Magnetic Force | 500G | 400G | 500G | 1.08 | 1.28 | 1.46 |
| | Angle from N1 | 40° | 0° | -40° | | | |
| Comparative Example 5 | Magnetic Force | 400G | 700G | 400G | 1.26 | 1.47 | 1.50 |
| | Angle from N1 | 30° | 0° | -30° | | | |
| Comparative Example 6 | Magnetic Force | 500G | 400G | 500G | 0.99 | 1.25 | 1.51 |
| | Angle from N1 | 60° | 0° | -45° | | | |

Diameter of Magnetic Roll: 16mm, Diameter of Developing Roll:16mm,
GAP btwn Magnetic Roll & Developing Roll: 0.8mm

Fig.7

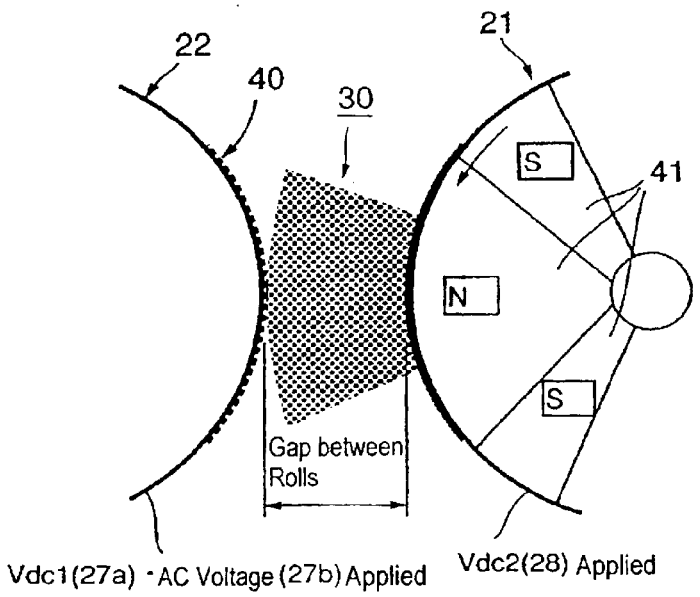

Fig.10

| | With No Residual Toner | With Residual Toner | | | |
|---|---|---|---|---|---|
| | Comparative Example 1 | C.Example 2 | C.Example 3 | Example 1 | Example 2 |
| Duty Ratio | 30% | 30% | 40% | 50% | 70% |
| Initial | 0. 00 | 0. 20 | 0. 20 | 0. 20 | 0. 20 |
| First Round | 0. 20 | 1. 10 | 1. 10 | 1. 38 | 1. 38 |
| Second Round | 1. 10 | 1. 40 | 1. 40 | 1. 45 | 1. 45 |
| Third Round | 1. 40 | 1. 45 | 1. 45 | 1. 45 | 1. 45 |
| Fourth Round | 1. 45 | 1. 45 | 1. 45 | 1. 45 | 1. 45 |
| ~ | ~ | | | | |
| Eleventh Round | 1. 45 | 1. 45 | 1. 45 | 1. 45 | 1. 45 |
| Twelfth Round | 1. 45 | 1. 45 | 1. 45 | 1. 45 | 1. 45 |

※ A Numeral on the table is an amount of toner on the developing roll in mg/cm

Fig.11

| | Gap between Developing Roll 22 and Magnetic Roll 21 | | | |
|---|---|---|---|---|
| | Example 3 | Example 4 | Example 5 | Example 6 |
| Gap | 0. 2mm | 0. 3mm | 0. 4mm | 0. 5mm |
| Initial | 0. 20 | 0. 20 | 0. 20 | 0. 20 |
| First Round | 1. 38 | 1. 38 | 1. 30 | 1. 25 |
| Second Round | 1. 45 | 1. 45 | 1. 45 | 1. 45 |
| Third Round | 1. 45 | 1. 45 | 1. 45 | 1. 45 |
| Fourth Round | 1. 45 | 1. 45 | 1. 45 | 1. 45 |
| ~ | ~ | | | |
| Eleventh Round | 1. 45 | 1. 45 | 1. 45 | 1. 45 |
| Twelfth Round | 1. 45 | 1. 45 | 1. 45 | 1. 45 |

※ Condition: with Residual Toner (Duty Ratio 50%)
A numeral on the table is an amount of toner on the developing roll in mg/cm

Fig.12

| Positive Duty Ratio (%) | | 20 | 30 | 40 | 50 | 60 | 70 |
|---|---|---|---|---|---|---|---|
| Developing Ghost (Initial) | | O | O | O | O | Δ | × |
| Image Consistency | Initial | 1.40 | 1.43 | 1.40 | 1.35 | 1.40 | 1.40 |
| | 5000 sheets | 1.39 | 1.38 | 1.38 | 1.30 | 1.25 | 1.20 |
| | 10000 sheets | 1.38 | 1.35 | 1.37 | 1.29 | 1.20 | 1.05 |
| Toner particle Size Number Average μm | | 7.50 | 7.48 | 7.45 | 7.40 | 7.15 | 7.00 |

Number Average Particle Size of Toner in Developer material 7.51
(Variance Ratio 1.23)

Fig.13

| Positive Duty Ratio (%) | | 20 | 30 | 40 | 50 | 60 | 70 |
|---|---|---|---|---|---|---|---|
| Developing Ghost (Initial) | | O | O | O | O | Δ | × |
| Image Consistency | Initial | 1.40 | 1.43 | 1.40 | 1.35 | 1.40 | 1.40 |
| | 5000 sheets | 1.25 | 1.22 | 1.20 | 1.17 | 1.13 | 1.12 |
| | 10000 sheets | 1.15 | 1.12 | 1.17 | 1.15 | 1.11 | 1.02 |
| Toner particle Size Number Average μm | | 7.00 | 6.80 | 6.50 | 6.30 | 6.20 | 6.00 |

Number Average Particle Size of Toner in Developer material 7.51
(Variance Ratio 1.23)

Fig.14

| | | Toner Particle Size Variance Ratio % (Volume Distribution/Number Distribution) | | | | |
|---|---|---|---|---|---|---|
| | | 1.40 | 1.30 | 1.23 | 1.20 | 1.10 |
| Image Consistency | Initial | 1.42 | 1.43 | 1.43 | 1.45 | 1.45 |
| | 5000 sheets | 1.20 | 1.32 | 1.42 | 1.42 | 1.43 |
| | 10000 sheets | 0.97 | 1.21 | 1.35 | 1.35 | 1.40 |
| Developing Sleeve | Toner particle Size (μm) | 9.10 | 9.30 | 9.50 | 9.20 | 9.60 |
| Particle Size Variation | Initial | 8.50 | 8.70 | 9.20 | 9.00 | 9.50 |
| | 10000 sheets | 7.30 | 7.60 | 8.90 | 9.00 | 9.20 |

Fig.15

| Thickness of Toner Layer (mg/cm²) | 0.4 | 0.6 | 1.0 | 1.3 | 1.6 | 1.8 | 2.0 |
|---|---|---|---|---|---|---|---|
| Ghost | ○ | ○ | ○ | ○ | ○ | × | × |
| Scattering | ○ | ○ | ○ | ○ | ○ | △ | × |
| Performance for Following Solid Images | × | ○ | ○ | ○ | ○ | ○ | ○ |

IMAGE FORMING APPARATUS AND IMAGE FORMING METHOD

BACKGROUND OF THE INVENTION

1. Field of the Invention

The present invention relates to an image forming apparatus and method, particularly to an image forming apparatus utilizing electrophotography such as a copying machine, a printer, a facsimile and a complex machine of those and its image forming method, more specifically, to an image forming apparatus having a hybrid developing apparatus which develops a latent image to which only charged toner is caused to jump from a developing roll holding the only charged toner on it using two components developer material, in which non-magnetic toner is charged by means of magnetic carrier.

2. Description of the Related Art

Heretofore, there are kinds of developing methods in an image forming apparatus utilizing electrophotography such as a copying machine, a printer, a facsimile and a complex machine of those. One is a two-components developer material method which uses toner and magnetic carrier; another is one-component developer material method which uses nonconductive toner or conductive toner, yet another is a hybrid developing method which develops a latent image to which only charged toner is caused to jump from a developing roll holding the only charged toner on it using two components developer material, in which non-magnetic toner is charged by means of magnetic carrier.

A two parts developer material method has advantages of such as excellent charging property of toner by carrier, long life of toner as well as uniformity of solid image. On the other hand, it has drawbacks of such as a large and complicated developing apparatus, generation of toner scattering or carrier accompanying as well as varying image quality depending on durability of carrier. A one-component developer material method has advantages of a compact developing apparatus as well as good dot reproducibility while it has drawbacks of the poor durability of a developing roll and a charge roller, which results in selective developing or high maintenance cost of supplies and material for developing apparatus. A hybrid developing method is a high rate image forming method which has good dot reproducibility and a long life, however it has heretofore such problems as generation of developing ghost or toner scattering.

Though a hybrid developing method has been developed as one of measures for a one-component non-contact developing, it has been recently developed as a high rate developing method for a developing method of superimposing multi-colors on one drum, in which a plurality of color images are sequentially formed on one latent image bearing body (a photosensitive body). Attention has been paid to this method as an art of quality color images because a color image with scarce color drift can be obtained by accurately overlapping different colored layers of toner on a latent image bearing body.

However, since developing apparatuses corresponding to a number of colors used should be disposed around the latent image bearing body in a developing method of superimposing multi-colors on one drum, the latent image bearing body becomes large in size so that this prevents from designing a compact image forming apparatus. Hence, attention has been paid to a tandem method in which a plurality of electro-photographic process units corresponding to colored toners used are aligned and colored images are formed synchronized with transferring of a transfer member so as to overlapping the colored images on the transfer member. However, this method has a drawback that the image forming apparatus becomes large because electro-photographic process units of kinds of colors should be aligned, though it has an advantage in having a rapid rate of printing. In order to improve measures for this problem, a compact tandem image forming apparatus has been proposed, which is provided with a small-sized image forming unit by narrowing a distance between latent image bearing bodies.

The compact tandem image forming apparatus thus designed has an advantage when it has a vertical developing apparatus in order to minimize a size in width direction of the image forming unit. That is, it is desirable regarding parts layout to dispose a developing apparatus in the upper part of the latent image bearing body. However, in case the developing apparatus is disposed in a vertical manner in a conventional two-components developer material method, flow of developer material, that is, the supply of developer material from a developer mixer to the part adjacent to a latent image bearing body is complicated so that downsizing of the apparatus is limited, carrier adheres inevitably to the latent image bearing body and toner scatters unavoidably.

Though, as another method, a one-component developer material method in which carrier is not used is proposed, it has a drawback of enhancing color drift, which is the weak point of a tandem type, on account of the torque fluctuation of a latent image bearing body caused by contacting a developing roll to the latent image bearing body. Meanwhile, with a method in which a latent image bearing body is not touched, toner is charged by a charge roll and the toner thickness on the developing roll is restricted by an elastic doctor blade. Thus, additive for toner adheres to the charge roll so that the charging ability is decreased or toner adheres to the doctor blade so that toner thickness becomes uneven, which results in image defects.

Hence, as a measure for resolving the problems, the aforementioned hybrid developing method has attracted attention. Though the hybrid developing method has the problems with regard to generation of ghost and scattering of toner, the method has little torque fluctuation owing to non-contacting between the developing roll and the image bearing body as well as excellent dot reproducibility so that it provides a high-speed image forming apparatus capable of a long life.

A prior art regarding a hybrid developing method is disclosed in U.S. Pat. No. 3,866,574 which proposes a method wherein a non-magnetic toner thin layer is formed on a donor roll (developing roll) disposed untouchably toward a latent image bearing body and the toner is caused to jump to the latent image on the latent image bearing body by an alternative current electric field. While, U.S. Pat. No. 3,929,098 shows a developing apparatus which forms a toner layer by transferring the toner onto a donor roll using a magnetic roll.

However, although these arts enable toner to form a thin layer on a donor roll by means of two-components developer material, a strong alternative current electric field is necessary to separate toner from the donor when the electrostatic charge of the toner is high. The strong alternative current electric field disturbs the toner layer so that a problem concerning superimposing multi-colors arises. In this regard, so called a powder cloud developing method is disclosed in Japanese laid open patent publication, No. JP1991-113474 wherein auxiliary electrodes consisting of wires are provided between a donor roll and a latent image bearing body applying a weak alternative current electric field so as not to disturb the toner developed.

Theoretical aspect of the formation of toner layer on a developing roll using two-component developer material was reported by Toshiba Corporation in the Electrophotography Society Journal 19, 2 (1981) and the art is disclosed in Japanese laid-open patent publication JP1984-121077.

The aforementioned prior arts have a tendency of decreasing image consistency owing to selective developing as coarse particles of the high developing natured toner are apt to selectively jump to the latent image body and fine particles of the highly charged toner remains on the developing roll sleeve. Further, the control of charging toner is complicated so that a high surface potential and a big developing electrical field need to be applied. In this regard, if both toner consumption region and non-consumption region are generated on the developing roll, toner adhering state and toner potential vary on the surface of the developing roll. Thus, as shown in FIG. 3, so called a hysteresis, a phenomenon in which a part of previous developing image appears as a ghost is liable to generate. In FIG. 3, 35 is a solid image consisting of a rectangular black image and 36, 37 are half tone image succeeding and broader than the solid image. When both toner consumption region and non-consumption region are generated on the developing roll, printing the half tone images 36, 37 after the solid image 35 generates the ghost shown in FIG. 3(*b*). Further in case high consistent images are printed repeatedly, unevenness of image such as mottle in image consistency is liable to occur so that a problem in down sizing the apparatus arises.

In order to overcome this problem, Japanese laid-open patent publication JP1999-231652 discloses a member for scraping the residual toner on a developing roll and a recovery device for the scraped toner, while Japanese laid-open patent publication JP2000-81788 discloses an apparatus using an exclusive recovery roll for assuring recovery of toner on the developing roll. However these methods are necessary for complex structures enabling to make practical for a compact electrophotographic apparatus. Further, Japanese laid-open patent publication JP1995-128983 discloses an apparatus wherein toner on a developing roll is recovered by setting a broad half value region of magnetic density of a magnetic roll as a measure for the hysteresis when using magnetic brushes. Japanese laid-open patent publication JP1988-249164 discloses a control method for a developing apparatus of tandem type wherein degradation of developer material is prevented by bringing down the operation of developing apparatus in an image forming part except for the image forming part whereat a transfer process is performed.

In a hybrid developing method, decreasing of image consistency owing to selective developing or developing defect, image degradation, developing ghost, toner scattering and sleeve adhesion owing to leaving for a long time while holding toner on a developing roll are generated. In order to solve the aforementioned problems, Japanese laid-open patent publication JP11994-67546, JP11995-72733 and JP11995-92804 disclose an image forming apparatus having a magnetic roll forming magnetic brushes by two-components developer material, a donor roll (developing roll) holding a toner thin layer supplied by the magnetic roll and electrodes disposed between the donor roll and a latent image bearing body wherein bias consisting of alternate current and direct current voltage are applied to the electrodes, direct current bias is applied to the developing roll and polarity reversible direct current bias by a switch (JP1995-72733) or alternate current bias superposed on direct current (JP1994-67546 and JP1995-92804) is applied to the magnetic roll.

In a developing apparatus described in JP31994-67546 or JP31995-72733, a toner thin layer is formed on the developing roll with magnetic brushes generated on the magnetic roll with direct current potential difference (JP1995-72733) or alternate current bias (JP1994-67546 and JP31995-92804) between the magnetic roll and the developing roll and further a latent image on the latent image bearing body is developed by forming toner cloud near the electrodes with an alternate current bias superposed on direct current applied between the developing roll and the electrodes while the toner on the developing roll is recovered by applying a direct current bias in the direction of peeling toner from the developing roll to the magnetic roll with switching after formation of images (JP1995-72733 and JP1995-92804) or at a definite interval (JP1994-67546) and by applying a direct current bias (JP1995-72733) in the direction of transferring toner on the magnetic roll to the developing roll with switching at the successive image formation, whereby formation of images are prepared to solve the above mentioned problems.

In JP2000-250294, it is argued that a method in which electrodes are provided between a developing roll and a latent image bearing body disclosed in JP1995-72733 has such draw back as an uneven phenomenon owing to vibration of wires tensed with electrical bias and generation of scars on the developing roll by dust attached instantaneously on the electrodes. A hybrid developing apparatus having electrodes buried in a developing roll is introduced as a prior art. Even in the apparatus using a developing roll with electrodes buried in the roll, carrier attached on the developing roll sticks to images and toner is not effectively supplied to the latent image bearing body because electrodes buried in the roll have a certain distance between them. Consequently, the apparatus generates a phenomenon of empty images when images of high image ratio are continuously printed or a phenomenon of low quality image or low image consistency caused by selective development on account of alternate current bias applied to the magnetic roll and the developing roll so that the patent publication disclosed a hybrid developing apparatus preventing these phenomenon.

Namely, in the patent publication JP2000-250294, a dielectric layer into which electrodes are buried with a small distance is provided on a electroconductive sleeve to constitute a developing roll whereby improving the effectiveness of supplying toner to a latent image bearing body, preventing short-circuiting between electrodes and protecting the surface. In addition, an electrode-relaxation-allowing layer having a dielectric constant with which cumulated electric charges can be diffused and capable of fringe charge penetrating through the coating for a shorter time than several seconds is provided. A brush electrode supplying a bias voltage consisting of alternate current voltage and dielectric current voltage to the electrodes buried in the developing roll is provided between the developing roll and the latent image bearing body and another brush electrode supplying another bias voltage consisting of alternate current voltage and dielectric current voltage to the electrodes buried in the developing roll is provided between the developing roll and magnetic roll, so that, a latent image on the latent image bearing body is developed with a cloud of toner between the latent image bearing body and the developing roll, and toner is reciprocated between the developing roll and the magnetic roll. The alternate current voltage source is common to the both biases and its wave is a square wave, a duty ratio of which is set in such a manner that a time for transferring toner from the magnetic roll to developing roll is shorter than a time for recovering toner from developing roll to the magnetic roll so as to prevent selective transfer of toner and carrier sticking to the developing roll utilizing the difference of inertia between toner and carrier.

The powder cloud developing method disclosed in the Japanese laid open patent publication, No. JP1991-113474 is not commonly practiced because weirs of auxiliary electrodes are apt to become dirty and image degradation generates owing to vibration. Further, the apparatuses disclosed in JP1999-231652, JP2000-81788 and JP1995-128983 have following drawbacks; namely, one needs a scratching device for toner and a recovery roll; another has a cause of degradation of toner durability owing to increasing toner stress by applying a special bias for recovery; yet another needs a long time for forming the layer on the developing roll at the time of developing reducing a developing speed. Further, after processing for a long time, charging property of toner varies greatly on the developing roll owing to degradation of durability of carrier leading to broadening the charging distribution of replenishing toner or recovered toner, which results in toner scattering or image fogging caused by poor toner charge. In addition, as the art needs a troublesome exchange of carrier, it does not have turned to a practical use.

In a tandem type developing apparatus disclosed in JP11988-249164, the action of developing apparatus except for an image forming part processing a transfer process needs to be stopped or the apparatus needs an apparatus or an control device for changing a high voltage applied between the developing roll and the magnetic roll with a high frequency resulting in cost up, while the apparatus has a structure of disposing donor roll, a magnetic roll and a stirrer member in a horizontal way so that downsizing of the apparatus is difficult.

An apparatus disclosed in JP1994-67546, JP1995-72733 (U.S. Pat. No. 5,341,197), JP1995-92804, or JP2000-250294 is operated by the powder cloud method in which the wires of the auxiliary electrodes are likely to get dirty and image degradation caused by vibration occurs; toner is recovered from the developing roll to the magnetic roll after an image is formed and a DC bias of which direction cause toner to transfer from the magnetic roll to the developing roll is applied by switching at the next image forming process; the toner layer becomes thinner by the right amount for one round of developing roll when toner is resupplied from the magnetic roll to the developing roll so that the image consistency of an image top end decreases to the extent of the toner layer thickness. This phenomenon occurs not only when toner is resupplied to the developing roll but also when developing is begun.

The apparatus disclosed in JP2000-250294 needs to bury electrodes into the developing roll and has a complicated and costly structure as necessary for a brush electrode for supplying the electrodes a superposed bias of AC and DC. The electrodes disposed intermittently in the circumferential direction while toner can not be controlled when the brush electrode becomes unable to contact the electrodes on the developing roll owing to sticking of toner caused by vibration or getting dirty for some reasons.

Further, as mentioned above, when highly consistent images are printed successively, fine particles of toner and contamination of toner constituents stick to the developing roll that causes toner filming leading to unevenness of images such as generation of heterogeneous image consistency. These are problems when downsizing the developing apparatus.

The present invention was done for solving the above-mentioned problems. An object of the present invention is to provide a compact, rapid and inexpensive image forming apparatus and method of the same having a hybrid developing apparatus wherein developing ghost and selective developing are avoided without complicating a developing apparatus and surly charged toner is supplied to a developing roll while stable quality images are obtained for a long time.

SUMMARY OF THE INVENTION

In order to attain these objects, according to the present invention, an image forming apparatus having a hybrid developing apparatus comprising a conveying body of two components developer material, which electrostatically charges developer material consisting of carrier and toner magnetically held thereon, and a developing roll, which forms an only toner thin layer on its surface by transferring the toner from the conveying body wherein latent images on a latent image bearing body are developed with the toner by applying developing bias to nearest approached regions (developing regions) between the developing roll and the latent image bearing body, is characterized in that a developing roll, which is electrically conductive at least on its surface, is directly confronted with a latent image bearing body through an insulative toner thin layer, and that a developing bias is applied to the electrically conductive surface of the developing roll, forming a continuous plane of electrode.

Thus, by making a hybrid developing apparatus with a simple structure in which a developing bias is applied to the developing roll having an electrically conductive surface, complicated structures such as providing an auxiliary electrode or burying electrodes in the developing roll is not necessary. Hence, such trouble as the image degradation owing to the vibration or staining of the wire electrodes or as uncontrollable toner because a brush electrode cannot be touched with the electrode of the developing roll is avoided. Since the surface of the developing roll is formed with a continuous electrically conductive electrode plane and a bias is applied directly to the developing roll so that developing becomes maximum at the nearest region between the developing roll and the latent image bearing body, and developing comes to an end as the distance increases after that, and toner which causes fog is recovered to the developing roll developing accurately the image on the latent image bearing body, a compact image forming apparatus having a hybrid developing apparatus which prevents fog and gives stable images for a long time can be provided.

Further, according to the present invention, an entire developing roll is electrically conductive and an alternate current bias superposed by a direct current bias thereon is applied onto the developing roll.

Thus, by applying an alternate current bias superposed by a direct current bias thereon on to the developing roll which is entirely electrically conductive, an excellent developing property between the latent image bearing body can be obtained and toner can be easily exchanged between the developing roll and the conveying body of developer material so that an image forming apparatus having a hybrid developing apparatus preventing selective developing and giving stable image quality can be provided.

Further, according to the present invention, a duty ratio of the alternative current bias is set as within the range from 10 to 50%.

Thus, by setting a duty ratio as within the range of 10 to 50%, a peak of an alternative current bias becomes sharp so that toner can be effectively recovered and recovery effect from the developing roll to the conveying body of developer material is enhanced so that toner staining of the developing roll is eliminated, and at the same time, toner is recovered effectively from the latent image bearing body to the developing roll so that fog is not likely to appear, whereby an image forming apparatus having a hybrid developing apparatus giving stable image quality can be provided.

Further, according to the present invention, the surface of the developing roll consists of an approximately uniform electro conductive sleeve having a conductivity of $10^6$ $\Omega \cdot cm^3$ or less.

Thus, since the surface of the developing roll consists of an approximately uniform electro conductive sleeve having a conductivity of $10^6$ $\Omega \cdot cm^3$ or less, the superposed AC, DC bias applied to the developing roll acts favorably between the rotating developing roll and the latent image bearing body and the magnetic roll so that image consistency does not decrease, leading to obtaining excellent images for a long time.

Further, according to the present invention, an image forming apparatus having a hybrid developing apparatus comprising a magnetic roll for conveying two components developer material, which electrostatically charges developer material consisting of carrier and toner magnetically held thereon, and a developing roll, which forms an only toner thin layer on its surface by transferring the toner from the conveying body utilizing a bias for transferring and magnetic brushes of the magnetic roll wherein latent images on a latent image bearing body are developed with the toner by applying developing bias to nearest approached regions (developing regions) between the developing roll and the latent image bearing body, is characterized in that both of the magnetic roll and the developing roll are electrically conductive at least on their surfaces, and that an independent bias is applied to each of the two rolls.

Thus, a hybrid developing apparatus is constructed with the simple structure wherein an independent bias is applied to each of the magnetic roll and the developing roll both of which have electrically conductive surfaces on them so that a complicated structure such as providing an auxiliary electrode or burying electrodes in the developing roll is unnecessary and therefore such trouble as the image degradation owing to the vibration or staining of the wire electrodes or as uncontrollable toner because a brush electrode cannot be touched with the electrode of the developing roll are avoided. Since the surface of the developing roll is electrically conductive and a bias is applied directly to the both rolls so that developing becomes maximum at the nearest region between the developing roll and the latent image bearing body, and developing comes to an end as the distance increases after that, and toner which causes fog is recovered to the developing roll developing accurately the image on the latent image bearing body and recovering the toner on the developing roll with these biases, a compact image forming apparatus having a hybrid developing apparatus which prevents fog and gives stable images for a long time can be provided.

Further, according to the present invention, a bias for conveying applied to the magnetic roll is a direct current bias and a bias for developing applied to the developing roll is a bias consisting of a direct current bias and an alternate current bias superposed thereon.

Thus, by applying a direct current bias to the magnetic roll for a bias for conveying and a bias consisting of a direct current bias and an alternate current bias superposed thereon to the developing roll for a bias for developing, an excellent developing property between the latent image bearing body and the developing roll can be obtained with a alternative current bias applied to the developing roll and toner can be easily exchanged between the developing roll and the magnetic roll so that an image forming apparatus having a hybrid developing apparatus preventing selective developing and giving stable image quality can be provided.

Further, according to the present invention, a direct current voltage of the bias for developing applied to the developing roll is fixed and a direct current voltage of the bias for conveying applied to the magnetic roll is varied on the condition as to whether it is the developing period or the non-developing period (no paper period) within the same polarity.

Thus, by fixing a direct current voltage of the bias for developing applied to the developing roll and varying a direct current voltage of the bias for conveying applied to the magnetic roll on the condition as to whether it is the developing period or the non-developing period (no paper period) within the same polarity, exchange of toner on the developing roll can be controlled without affecting developing of a latent image on the latent image bearing body so that an image forming apparatus having a hybrid developing apparatus preventing selective developing and giving stable image quality for a long time can be provided.

Further, according to the present invention, an angle between a magnetic pole on the magnetic roll nearest to the developing roll and each of both magnetic poles adjacent to that pole on the magnetic roll is 30 degrees or less respectively.

Thus, since an angle between a magnetic pole nearest to the developing roll and each of both magnetic poles adjacent to that pole on the magnetic roll is 30 degrees or less respectively, magnetic brushes between the magnetic pole nearest to the developing roll and each of the both magnetic poles adjacent to that pole rise to the developing roll side so that the contact region of magnetic brush to the developing roll increases greatly. Consequently, when a bias for conveying toner onto the developing roll from the magnetic roll is applied, a predetermined saturated toner layer is instantaneously formed so that the image consistency of the top end of an image does not decrease, though it decreases often with conventional arts in case toner is resupplied to the developing roll after toner is recovered from the developing roll when an image is completely formed or developing begins, which results in providing an image forming apparatus having a hybrid developing apparatus giving stable image quality for a long time.

Further, according to the present invention, an intensity of magnetic force of the magnetic pole nearest to the developing roll on the magnetic roll is lower than an intensity of magnetic force of each of the both magnetic poles adjacent to that pole.

Thus, by setting an intensity of magnetic force of the magnetic pole nearest to the developing roll on the magnetic roll as lower than an intensity of magnetic force of each of the both magnetic poles adjacent to that pole, a comparatively wide developing nip of magnetic brushes can be formed along the circumference of the developing roll so that toner layer formation on the developing roll is effectively and rapidly made; therefore, the image consistency of the top end of an image does not decrease, though it decreases often with conventional arts in case toner is resupplied to the developing roll after toner is recovered from the developing roll when an image is completely formed or developing begins, which results in providing an image forming apparatus having a hybrid developing apparatus giving stable image quality for a long time.

Further, according to another aspect of the present invention, an image forming method comprising applying a developing bias for toner developing on a latent image bearing body to nearest approached regions (developing regions) between a developing roll and the latent image bearing body wherein an only toner thin layer is formed on the developing roll by utilizing a bias for conveying and magnetic brushes of the magnetic roll for conveying two components developer material which electrostatically charges developer material consisting of carrier and toner magnetically held thereon, is characterized in that a direct current bias is applied to the magnetic roll and a bias consisting of a direct current bias and an alternate current bias superposed thereon to the developing roll, and that sources of the direct current biases are independent from each other while a voltage of one of the direct current biases and a duty ratio of the alternate current bias are varied so as to refresh (recover and exchange) toner on the developing roll.

Thus, by applying direct current biases on the magnetic roll and the developing roll respectively with independent sources each other while varying a voltage of one of the direct current biases and a duty ratio of the alternate current bias, at least one thin layer on the developing roll is left while toner at the base part of the developing roll can be peeled off so that developing histories are erased while toner peeled off from the developing roll is recovered without agglomerating on the magnetic roll and is mixed with newly replenished toner resupplying smoothly to the developing roll. Therefore, generation of developing ghost and selective developing is prevented and surely charged toner is supplied to the developing roll without complicating the developing apparatus while unevenness of images is not generated even when successive printing, which results in providing an image forming apparatus having a hybrid developing apparatus giving stable image quality for a long time.

Further, according to the present invention, a duty ratio of the alternate current bias is from 50% to 70%.

Thus, by setting a duty ratio as from 50% to 70%, at least one thin layer on the developing roll is left when toner on the developing roll is recovered while toner at the base part of the developing roll can be peeled off so that a toner layer is formed which is capable of developing on the developing roll for the first round of the rotation of the developing roll without taking time for forming again a toner layer.

Further, according to the present invention, a gap between the developing roll and the magnetic roll is within the range of from 0.2 mm to 0.5 mm and a rotational direction of the developing roll is the same as the magnetic roll.

Thus, since a gap between the developing roll and the magnetic roll is within the range of from 0.2 mm to 0.5 mm, toner is transferred rapidly; since a rotational direction of the developing roll is the same as the magnetic roll, for example, when the developing roll rotates counterclockwise, the magnetic roll rotates also counterclockwise, toner is recovered favorably from the developing roll.

Further, according to the present invention, a period when developing is ceased for refreshing (recovering and exchanging) toner is a period between printing paper sheets (during a succession of paper sheets is being transported) and/or a period after printing (after a succession of paper sheets has been transported).

Thus, by refreshing toner during a period between printing paper sheets (during a succession of paper sheets is being transported) and/or a period after printing (after a succession of paper sheets has been transported), always adequate toner is supplied on the developing roll without affecting printing at all even if high consistent images are printed successively so that mottle in image consistency can be prevented while a sufficient printing rate is maintained. Hence, generation of ghost and poor performance for following solid images are prevented whereby providing an image forming method giving excellent images for a long time.

Further, according to the present invention, an image forming method comprising applying a developing bias for toner developing on a latent image bearing body to nearest approached regions (developing regions) between a developing roll and the latent image bearing body wherein an only toner thin layer is formed on the developing roll by utilizing a bias for conveying and magnetic brushes of the magnetic roll for conveying two components developer material which electrostatically charges developer material consisting of carrier and toner magnetically held thereon, is characterized in that a direct current bias is applied to the magnetic roll and a bias consisting of a direct current bias and an alternate current bias superposed thereon to the developing roll, and that sources of the direct current biases are independent from each other while, by varying one of the direct current biases, a part of toner on the developing roll is recovered during a period between printing paper sheets or printing data when the printing data is continuous and all the toner is recovered when the printing is completed.

Thus, since toner is recovered by varying one of the direct current biases in the state that a direct current bias is applied to the magnetic roll and a bias consisting of a direct current bias and an alternate current bias superposed thereon to the developing roll with independent sources of the direct current biases each other, a complicated structure such as an auxiliary electrode or buried electrodes in the developing roll is not necessary so that a bias according to the state of developing can be applied to the developing roll and the magnetic roll. Hence, an image forming method preventing fog and giving excellent images for a long time can be provided.

Further, according to the present invention, an image forming method comprising applying a developing bias for toner developing on a latent image bearing body to nearest approached regions (developing regions) between a developing roll and the latent image bearing body wherein an only toner thin layer is formed on the developing roll by utilizing a bias for conveying and magnetic brushes of the magnetic roll for conveying two components developer material which electrostatically charges developer material consisting of carrier and toner magnetically held thereon, is characterized in that a direct current bias is applied to the magnetic roll and a bias consisting of a direct current bias and an alternate current bias superposed thereon to the developing roll, that sources of the direct current biases are independent from each other, and that, by varying one or both of the direct current biases while a voltage value of the bias on the magnetic roll is maintained higher than a voltage value of the bias on the developing roll, toner on the developing roll is recovered so that a part of toner remains on the developing roll after developing.

Thus, since sources of the direct current biases are independent from each other, and by varying one or both of the direct current biases while a voltage value of the bias on the magnetic roll is maintained higher than a voltage value of the bias on the developing roll, toner on the developing roll is recovered so that a part of toner remains on the developing roll after developing, a complicated structure such as an auxiliary electrode or buried electrodes in the developing roll is not necessary and a toner thin layer is rapidly formed on the developing roll at the beginning of developing. Hence, an image forming method preventing decreasing of image consistency or fog and giving excellent images for a long time can be provided.

Further, according to the present invention of image forming method, a duty ratio of the alternate current bias is set as within the range from 10 to 50%.

Thus, by setting a duty ratio of the alternate current bias as within the range of 10 to 50%, a peak of an alternative current bias becomes sharp so that toner can be effectively recovered and recovery effect from the developing roll to the conveying body of developer material is enhanced so that toner staining of the developing roll is eliminated, and at the same time, toner is recovered effectively from the latent image bearing body to the developing roll so that fog is not likely to appear, whereby an image forming apparatus having a hybrid developing apparatus giving stable image quality can be provided.

Further, according to the present invention, an image forming method further comprises making up the surface of the developing roll with an approximately uniform electro conductive sleeve having a conductivity of $10^6$ $\Omega\cdot cm^3$ or less, and making an applied bias consisting of a direct current bias and an alternate current bias superposed thereon act between the developing roll and the electrostatic latent image bearing body and between the developing roll and the magnetic roll.

Thus, by making up the surface of the developing roll with an approximately uniform electro conductive sleeve having a conductivity of $10^6$ $\Omega\cdot cm^3$ or less, a bias consisting of a direct current bias and an alternate current bias superposed thereon applied on the developing roll acts appropriately between the rotating developing roll and the latent image bearing body and the magnetic roll. Hence, an image forming method preventing decreasing of image consistency even after a long use and giving stable image quality for a long time can be provided.

Further, according to the present invention, an image forming method further comprises making a ratio of a volume average particle size to a number average particle size of the toner which the developer material contains 1.25 or less and controlling an average particle size of the carrier as 50 $\mu$m or less.

Thus, by making a ratio of a volume average particle size to a number average particle size of the toner which the developer material contains 1.25 or less and controlling an average particle size of the carrier 50 $\mu$m or less, lowering of developing property owing to depositing finer particles of toner during successive printing is prevented avoiding increase of stress to carrier so as to stabilize an amount of toner supply to the developing roll and to allow sufficient charging to the toner in the developer material, which leads to stable developing.

Further, according to the present invention, an image forming method further comprises controlling an amount of charge of the toner which the developer material contains within the range of from 5 to 20 $\mu$C/g.

Thus, by controlling an amount of charge of the toner which the developer material contains within the range of from 5 to 20 $\mu$C/g, selective developing is prevented and a toner layer thickness is controlled to an optimum value so as to avoid toner scattering and no to lower developing property.

Further, according to the present invention, an image forming method comprises controlling a toner thickness to 50 $\mu$m or less and a toner amount within range of from 0.5 to 1.7 mg/cm$^2$.

Thus, by controlling a toner thickness to 50 $\mu$m or less and a toner amount within range of from 0.5 to 1.7 mg/cm$^2$ an image forming method without toner scattering and developing ghost can be provided.

BRIEF DESCRIPTION OF THE DRAWINGS

FIG. 3 is a schematic drawing illustrating generation of ghost.

FIG. 4 is a table showing a relationship between a volume resistivity of a sleeve on a developing roll and maintaining property of an image consistency.

FIG. 5 is a schematic drawing illustrating the relation of positions between a magnetic pole on the magnetic roll nearest to the developing roll and both magnetic poles adjacent to that pole.

FIG. 6 is a table showing an angle between a magnetic pole on the magnetic roll nearest to the developing roll and each of both magnetic poles adjacent to that pole on the magnetic roll and a toner amount corresponding to a number of rotation of the developing roll when the magnetic force of each magnetic pole is varied.

FIG. 7 is a schematic drawing illustrating a case that a toner thin layer on the developing roll is recovered to the magnetic roll.

FIG. 10 is a table showing a relationship between a number of rotations of the developing roll 22 and an amount of toner when a toner thin layer is formed.

FIG. 11 is a table showing a varied amount of toner on the developing roll 22 when the gap between the magnetic roll and the developing roll is varied.

FIG. 12 is a table showing ghost performances and image consistencies at various numbers of printing sheets respectively and toner particle sizes after 10000 sheets printing according to varied positive duty ratios in case a direct current bias after developing (between paper sheets) is varied from the bias during developing.

FIG. 13 is a table showing ghost performances and image consistencies at various numbers of printing sheets respectively and toner particle sizes after 10000 sheets printing according to varied positive duty ratios in case a direct current bias after developing (between paper sheets) is not varied from the bias during developing.

FIG. 14 is a table showing a relation between a particle size distribution and a property of maintaining image consistency, and variation of toner particle size with respect to a number of printing sheets.

FIG. 15 is a table showing various properties such as ghost, toner scattering or performance for following solid images corresponding to various values of toner layer thickness.

DETAILED DESCRIPTION OF THE PREFERRED EMBODIMENTS

The invention will now be described less in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

First Embodiment

Figure 1:
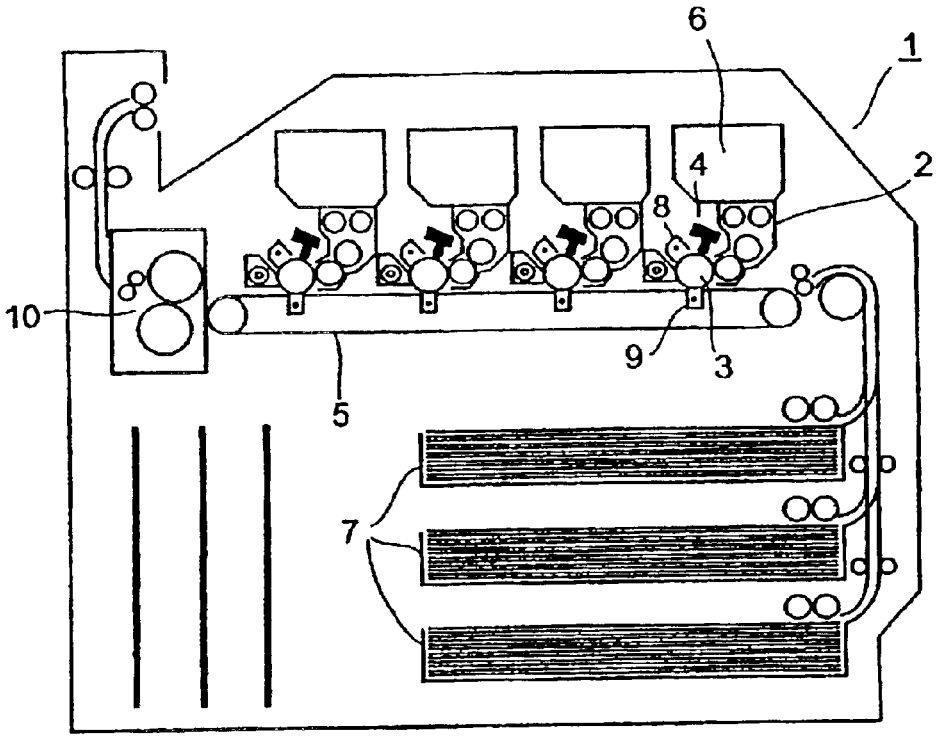
FIG. 1 is a schematic drawing illustrating an embodiment of a tandem type image forming apparatus having a hybrid developing apparatus according to the present invention.
Figure 2:
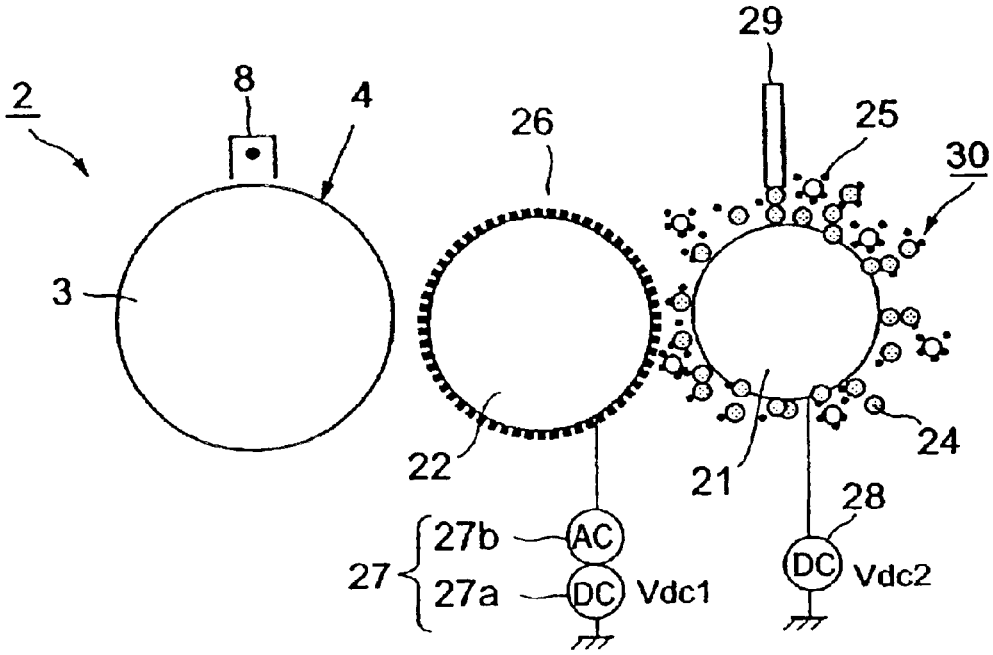
FIG. 2 is a schematic drawing illustrating a hybrid developing apparatus according to the present invention.

FIG. 1 to FIG. 4 are schematic drawings illustrating a first embodiment of the present invention. FIG. 1 is a schematic drawing illustrating an embodiment of a tandem type image forming apparatus having a hybrid developing apparatus according to the present invention; FIG. 2 is a schematic drawing illustrating a hybrid developing apparatus according to the present invention; FIG. 3 is a schematic drawing illustrating generation of ghost; and FIG. 4 is a table showing a experimental results between a volume resistivity of a sleeve on a developing roll and maintaining property of an image consistency in the first embodiment of the present invention.

In FIG. 1, 1 is a main body of a tandem type image forming apparatus; 2 is a developing apparatus; 3 is a latent image bearing body (a photosensitive body); 4 is an exposing unit; 5 is a conveying belt for recording media; 6 is a developer material container; 7 is a cassette for supplying paper, 8 is a charging device for charging the latent image bearing body; 9 is a transferring device for transferring a toner image on the latent image bearing body 3 to a recording medium by a transferring bias; 10 is a fixing device fro fixing a transferred image on the recording medium. In a tandem type image forming apparatus, it is important to design compactly a charging device 8, an exposing unit 4, a developing apparatus 2, a transferring device 9, a cleaning device and others disposed around the latent image bearing body (the photosensitive body). In this embodiment, a developing apparatus is disposed in a vertical direction and adjacent to the latent image bearing body.

In FIG. 2, 21 is a magnetic roll as a developer material conveying body, which supplies toner 25 to a developing roll 22 by generating magnetic brushes 30 of two components developer material with magnets provided inside thereof; 22 is a developing roll holding a toner thin layer 26 for developing an electrostatic latent image on the latent image bearing body 3; 24 is carrier; 25 is toner, 26 is a toner thin layer on the developing roll 22; 27is a developing bias for developing by causing toner 25 of the toner thin layer formed on the developing roll jump to the latent image bearing body wherein 27*a* is a DC bias ($V_{dc1}$) and 27*b* is an AC bias; 28 is a DC bias ($V_{dc2}$) for transferring toner 25 from magnetic brushes 30 on the magnetic roll 21 to the developing roll 22; and 29 is a doctor blade which restricts a thickness of the magnetic brushes 30 on the magnetic roll.

As a material for the latent image bearing body (photosensitive body) 3, a substance such as amorphous silicon (a-Si), organic photo conductor (OPC) or others can be used. Organic photo conductor which charges positive electricity (positive OPC) generates little ozone so that charge is stable. Particularly, as a single layer structure of organic photoconductor which charges positive electricity have an unvarying photosensitive characteristic and a stable image quality even though a film thickness is varied owing to using for a long time, it is appropriate for a system for a long life. When organic photoconductor which charges positive electricity is used for a long life system, a film thickness is preferably 20 to 40 $\mu$m. In case of 20 $\mu$m or less thickness, generation of black spots are apparent by dielectric breakdown when a film thickness becomes 10 $\mu$m or so. In case of 40 $\mu$m or greater thickness, sensitivity lowers causing lowering of image consistency.

Semiconductor laser or LED can be used for an exposing unit 4. A wavelength of approximately 770 nm is effective when positive OPC is used; a wavelength of approximately 685 nm is effective when amorphous silicone photosensitive body is used. As an embodiment of the present invention, a case using positive OPC for the latent image bearing body 3 and LED for a light source of the exposing unit 4 is explained hereinafter.

An outermost surface of the developing roll 22 consists of a sleeve of aluminum, SUS or conductive resin film, which has an even conductivity and a volume resistivity of $10^6$ $\Omega\cdot cm^3$ or smaller. A DC bias ($V_{dc1}$) 27*a* and a AC bias 27*b* is connected so that a DC bias and a bias consisting of a DC bias and an AC bias superposed thereon act between the rotating developing roll 22, latent image-bearing body 3 and the magnetic roll 21. The alternate current component that the AC bias 27*b* supplies consists of a square waves having a duty ratio of 50% or less. According to the present invention, the DC bias ($V_{dc1}$) 27*a* is set as 100 V; the $V_{pp}$, the frequency and the duty ratio of the AC bias 27*b* are set as 1.5 kV, 3.0 kHz and 30% respectively as an example. As stated above, the DC bias ($V_{dc1}$) 27*a* and the AC bias 27*b* are applied directly to the developing roll 22 and the outermost surface of the developing roll consists of an electroconductive material having a volume resistivity of $10^6$ $\Omega\cdot cm^3$ so that sharp bias components can be applied between the developing roll 22 and the latent image bearing body 3, and between the developing roll and the magnetic roll 21 whereby enhancing reactivity of toner layer formation at the beginning of developing.

The magnetic roll 21 holds two-component developer material consisting of carrier 24 and toner 25 as a transporter for developer material, generating magnetic brushes 30 whose thickness is restricted by the doctor blade 29 and supplying the toner 25 to the developing roll 22. A gap between the doctor blade and the magnetic roll is preferably 0.3 to 1.5 mm. The toner 25 is supplied to the developing roll by a potential difference between the DC bias ($V_{dc2}$) 28 applied to the magnetic roll and DC bias ($V_{dc1}$) 27*a* applied to the developing roll and by the AC bias 27*b*. The voltage of the DC bias ($V_{dc2}$) 28 is 350 V as a example of the present invention and in order that the toner layer on the developing roll 22 may be exchanged after developing, the DC bias ($V_{dc2}$) 28 is converted as the AC bias 27*b* is applied so as to recover the toner thin layer 26 on the developing roll 22 to the magnetic brushes 30. A value changed of the DC bias (Vdc2) 28 is kept greater than a value which generates a potential in the direction for always transferring the toner of the magnetic brushes 30 to the developing roll 22, that is, a DC bias voltage to the magnetic roll is kept greater than that of the developing roll and if the DC bias ($V_{dc1}$) is 100 V, the value is greater than 100V (as for this example, the value between 100 V and 350 V). Regarding the variation of the DC bias, though the DC bias ($V_{dc2}$) 28 is converted in the above example, both a DC bias ($V_{dc2}$) 28 and a DC bias ($V_{dc1}$) 27*a* can be converted if a DC bias voltage of the magnetic roll 21 is kept greater than a DC bias voltage of the developing roll.

Conductivity of the sleeve on the developing roll 22 is related to maintaining property of printing consistency. The variation of image consistency (initial 1.43) after printing 10,000 sheets is shown in FIG. 4. A DC bias ($V_{dc1}$) 27*a* applied t the developing roll 22 is 100 V; A $V_{pp}$, a frequency and a duty ratio of the AC bias are 1.5 kV, 3.0 kHz and 30% respectively; and a DC bias ($V_{dc2}$) 28 is 350V. As a result: if a volume resistivity of the sleeve material is $10^7$ Ω·cm$^3$ or greater, image consistency after printing 10,000 sheets decreases extremely, and if it is $10^6$ Ω·cm$^3$ or less, there is almost no problem with regard to image consistency.

A gap between the latent image bearing body 3 and the developing roll 22 is approximately 250 μm as an example and no wire electrode is used between them. A gap between the latent image bearing body 3 and the developing roll 22 is usually 150 μm to 400 μm , preferably 200 μm to 300 μm. If the gap is less than 150 μm, it causes fogging. If it is grater than 400 μm, it becomes difficult to cause the toner 25 to jump to the latent image bearing body 3 so that enough image consistency cannot be obtained and causes selective developing. A gap between the magnetic roll 21 and the developing roll 22 is approximately 0.2 to 1.5 mm.

Developer material consists of toner 25 and carrier 24. It is important that the toner 25 is restricted with regard to its particle size distribution. Generally, a particle size distribution of toner is measured by a Coulter counter and a breadth of particle size distribution of a toner is expressed as a ratio of a volume average particle size and a number average particle size. In order to prevent selective developing, it is important to make the ratio small. The broader the distribution becomes, the more toner having a comparatively small particle size is deposit on the developing roll so that performance for developing decreases. According to the present invention, an amount of toner charge is controlled within the range of 5 μC/g to 20 μC/g to prevent selective developing. The amount of toner charge is related also to a layer thickness of the toner thin layer 26 formed on the developing roll 22 so that the thickness of the toner layer becomes thick when the amount of toner charge is as low as 10 μC/g or less, particularly 5 μC/g or less, leading to increasing scattering of toner. While, when the amount of toner charge is 20 μC/g or greater, the toner layer thickness becomes thin so that toner performance regarding developing decreases owing to high charge. The amount of toner charge is measured by sucking the toner thin layer 26 on the developing roll with a QM meter of Trek Co. In the present invention, a case of using positively charged toner is explained as an example. However, negatively charged toner may be also used by reversing the relation to the bias.

As for carrier 24, magnetite carrier, ferrite of Mn series, ferrite of Mn—Mg series can be used and surface treated material may also be used unless an appropriate resistivity does not increase. According to the present invention, silicone resin treated ferrite carrier having a volume resistivity of $10^8$ Ω·cm$^3$, a saturation magnetization of 70 emu/g and an average particle size of 35 μm is used as an example. When the average particle size exceeds 50 μm, the stress of carrier increases while the toner consistency can not be raised so that the toner supply to the developing roll diminishes. When the average particle size of carrier is less than 50 μm, enough charge is given so that stable developing can be carried out even when the toner concentration in the developer material ranges from 5 to 20%.

The mixing ratio of toner 25 and carrier 24 is from 5 to 20 weight % of toner per total amount of toner 25 and carrier 24, preferably from 5 to 15 weight %. When the mixing ratio of toner 25 is less than 5%, the amount of toner charge becomes high so that enough image consistency can not be obtained, while, when it exceeds 20%, toner can not get enough charge so that toner scatters from a developing device contaminating the inner part of an image forming apparatus or generating toner fogging on the images.

The thickness of a toner thin layer 26 ranges from 10 to 100 μm, preferably from 30 to 70 μm. The thickness corresponds to 5 to 10 layers of the toner 25 and to 1/10 to 1/4 of the gap between the developing roll and the latent image bearing body (150 to 400 μm, preferably 200 to 300 μm). Thus, according to the present invention, the thickness of the toner 25 layer formed on the electro-conductive sleeve on the developing roll is 50 μm or less and the toner amount is controlled within the range of from 0.5 to 1.7 mg/cm$^2$, preferably 0.5 to 1.5 mg/cm$^2$ whereby forming clear images on the latent image bearing body 3 and at the same time easing the exchange of toner on the developing roll 22, which result in controlling developing ghosts.

The thickness of the toner thin layer 26 is determined by the difference between the DC bias ($V_{dc2}$) 28 and the DC bias ($V_{dc1}$) 27*a* and the amount of toner charge. In case the amount of toner charge is as low as 10 μC/g or less, particularly 5 μC/g or less, the toner layer becomes thin, rising the charge so that toner performance regarding developing diminishes. As described above, when the DC bias ($V_{dc1}$) 27*a* is set as 100 V and the DC bias ($V_{dc2}$) 28 as 350 V, the toner layer having a thickness of 40 μm is obtained. The toner amount per unit area in this condition is about 1.0 mg/cm$^2$. When the toner thin layer 26 is as thin as 0.5 mg/cm$^2$ or less, the following property of consistency is declined in case of successive printing of high consistent images, resulting in liability of generation of uneven images. When the toner layer is as thick as greater than 1.5 mg/cm$^2$, developing ghost as shown in FIG. 3 and toner scattering become noticeable. That is, as described above, in the FIG. 3, 35 is a rectangular, black and solid image. 36 and 37 are half tone images which succeed it and are broader than the former solid image 35. When a toner consumption region and a toner non-consumption region are generated on the developing roll and the half tone images 36, 37 are printed successively after printing the solid image 35, a ghost as 38 shown in FIG. 3(*b*) is generated. A uniform image is obtained when a toner layer thickness. A toner layer thickness becomes appropriate by varying a value of the DC bias ($V_{dc2}$) 28 according to data amounts so that a uniform image can be obtained.

In order to exchange the toner thin layer 26 on the developing roll 22, the toner thin layer 26 on the developing roll 22 is recovered to the magnetic brushes 30 by varying the DC bias ($V_{dc2}$) 28 in the state of applying the AC bias 27*b*. The exchange of toner on the developing roll 22 is enhanced by rotating the magnetic roll 21 one to two times as fast as the developing roll. It is preferable that the magnetic roll 21 rotates in the same direction as the developing roll 22; for example, when the developing roll 22 rotates counterclockwise, the magnetic roll rotates also counterclockwise. If the rotational rate ratio does not exist, toner recovery from the developing roll 22 is not enough; if the ratio is two or more, a rotational rate of the developing roll increases so that vibration or heat generation occurs which causes increasing stress to the toner.

For supplying a latent image on the latent image bearing body 3 enough toner without taking large distance between sheets, toner is exchanged rapidly when the circumference rotating rate of the developing roll 22 is set as 1.1 times or more than that of the latent image bearing body 3. When the rate ratio is 1.1 times or less, time when developing begins is late so that an enough sheets distance is required, resulting in failure in rapid printing.

In a tandem type image forming apparatus having a hybrid developing apparatus thus constructed according to the present invention, two components developer material consisting of toner 25 corresponding to an individual color such as yellow, cyan, magenta or black and carrier 24 is supplied to the developing apparatus 2 from the developing container 6, forming the magnetic brushes 30 on the magnetic roll 21 as shown in FIG. 2 and charging the toner 25 by stir. The magnetic brushes 30 on the magnetic roll 21 is restricted with its layer thickness by the doctor blade 29 and the toner thin layer 26 is formed on the developing roll 22 by the potential difference between the DC bias ($V_{dc2}$) 28 applied to the magnetic roll 21 and the DC bias ($V_{dc1}$) 27*a*, and AC bias 27*b*.

When the signal for beginning printing is transmitted from an unshown control circuit, the latent image bearing body 3 comprising organic photosensitive material taking a positive charge (positive OPC) is charged at first by the charging device 8, for example to 400 V and after that, the latent image bearing body 3 is exposed by LED which an exposing unit comprises and having a wave length of 770 nm to a potential of 70 V after exposing to form a latent image. The latent image is developed to form a toner image with toner caused to jump to the latent image bearing body 3 from the toner thin layer 26 on the developing roll 22 by the DC bias ($V_{dc1}$) 27*a* and AC bias 27*b*.

By the time a toner image is formed on the latent image bearing body 3, a recording medium is taken from a cassette for supplying paper and transported onto a transporting belt 5. A toner image is transferred by applying a transfer bias by a transfer device 9 disposed at the transfer position of individual color. The toner image of each color is sequentially transferred to the recording medium, which reaches a fixing device 10, is fixed, and discharged.

The AC bias 27*b* applied to the developing roll is a square wave having a duty ratio of 50% or less. The period for transporting toner 25 from the magnetic roll 21 to the developing roll is shorter than the period for recovering toner 25 from the developing roll 22 to the magnetic roll 21. Because the DC bias (Vdc1) 27*a* and the AC bias 27*b* is applied directly to the developing roll and the outermost surface of the developing roll 22 is made of electroconductive material having a volume resistivity of $10^6$ $\Omega\cdot cm^3$ or less, AC component of the bias for recovering the toner thin layer 26 on the developing roll to the magnetic roll 21 has a sharp peak so as to recover the toner 25 effectively. Therefore, the effectiveness of recovering toner from developing roll 22 to the magnetic roll 21, which is a transporter for developer material, is enhanced so that staining of the developing roll 22 with toner is prevented and recovery of toner from the latent image bearing body 3 toward the developing roll is effectively performed, which result in providing a developing apparatus capable of obtaining quality images having long stability and preventing generation of fogging.

Voltage values of the DC bias ($V_{dc1}$) 27*a*, the AC bias 27*b* or the DC bias 28, $V_{pp}$ or the frequency that has been explained above are for examples and are obviously variable depending on situation.

Second Embodiment

In a second embodiment of the present invention described less, constitutions of apparatuses and restricted conditions described by and shown in FIGS. 1, 2 and 3 in the first embodiment are the same as in the second embodiment unless otherwise specifically described. The explanation done in the first embodiment is to be replaced in the second embodiment as far as FIGS. 1, 2 and 3 are concerned, though the explanation in the second embodiment is omitted. It follows therefore that the second embodiment will be described by adding and referring to FIGS. 5 and 6.

FIG. 5 is a schematic drawing illustrating the relation of positions between a magnetic pole on the magnetic roll nearest to the developing roll and both magnetic poles adjacent to that pole; and FIG. 6 is a table showing an angle between a magnetic pole on the magnetic roll nearest to the developing roll and each of both magnetic poles adjacent to that pole on the magnetic roll and a toner amount corresponding to a number of rotation of the developing roll when the magnetic force of each magnetic pole is varied.

The magnetic roll 21 has a rotative sleeve including a fixed magnets integration of a plurality of magnetic poles which comprises a magnetic pole N1 nearest to the developing roll 22, both magnetic poles S1, S4 adjacent to that pole on the magnetic roll, a shield magnetic pole N2 disposed facing to the under part of the developer material container, a blade magnetic pole N3 adjacent and confronting to the doctor blade and separating blades S4, S3. In the second embodiment of the present invention, an angle between a magnetic pole N1 nearest to the developing roll and each of both magnetic poles S1, S4 adjacent to that pole on the magnetic roll, among magnetic poles of the magnetic roll, is 30 degrees or less respectively and a magnetic force of the magnetic pole N1 nearest to the developing roll is lower than a magnetic force of each of both magnetic poles S1, S4 adjacent to that pole.

When toner is recovered from the developing roll 22 to the magnetic roll 21 during paper sheets after forming an image and then toner is supplied to the developing roll 22 from the magnetic roll 21 for forming a next image or toner is supplied at the beginning of developing besides resupplying to the developing roll, a toner layer becomes thin only at one round rotation of the developing roll so that an image consistency of the top end of the image decreases. In order to prevent the phenomenon and saturate with the predetermined amount of toner on the developing roll at the first one round rotation of the roll, a supplying capacity of toner of magnetic brushes 30 on the magnetic roll 21 need to be improved.

As a measure in respect of the problem, a relative rate of rotation of the magnetic roll 21 to the developing roll 22 could be increased. However, a driving torque of the developing apparatus needs to be up and developer material is deteriorated rapidly if a circumference rate of rotation is increased over a certain amount. A blade gap between the magnetic roll 21 and the doctor blade 29 is widened so as to increase a flow amount of developer material and make a pool of developer material to enlarge a nip of developer material. However, because of making a pool, a driving torque of the developing apparatus needs to be up and developer material is deteriorated rapidly, as in the case of the above.

Further, the developer material pool inhibits toner supplying power of an alternate current bias with the developing apparatus construction of the present invention. That is because ordinary bristles of the magnetic brushes 30 make toner easy to move with an alternate current bias for reaching the developing roll 22 while a pool of developer material presses the developer material to the developing roll 22 so that toner in the pool is not easily affected by an alternate current bias, only toner of the vicinity of the magnetic pole nearest to the developing roll 21 being transferred.

Accordingly, in the second embodiment of the present invention, as described before referring to FIG. 5, an angle between a magnetic pole N1 nearest to the developing roll and each of both magnetic poles S1, S4 adjacent to that pole on the magnetic roll, among magnetic poles of the magnetic roll, is 30 degrees or less respectively and a magnetic force of the magnetic pole N1 nearest to the developing roll is lower than a magnetic force of each of both magnetic poles S1, S4 adjacent to that pole so that a relative rate of rotation of the magnetic roll 21 to the developing roll 22 is suppressed to comparatively low while a predetermined saturated amount of toner layer can be formed on the developing roll at the first one round rotation of the roll concurrently with application of the developing bias.

Thus, magnetic brushes between the magnetic pole N1 nearest to the developing roll and each of the both magnetic poles S1, S4 adjacent to that pole rise to the developing roll 22 side, and a comparatively wide developing nip of magnetic brushes 30 can be formed. As a result, the contact region of magnetic brushes 30 to the developing roll increases greatly, and further a predetermined saturated toner layer is instantaneously formed on the developing roll 22. Consequently, when a bias for conveying toner onto the developing roll from the magnetic roll is applied, a predetermined saturated toner layer is instantaneously formed so that the image consistency of the top end of an image does not decrease, though it decreases often with conventional arts in case toner is resupplied to the developing roll after toner is recovered from the developing roll when an image is completely formed or developing begins, which results in providing an image forming apparatus having a hybrid developing apparatus giving stable image quality for a long time.

Toner amounts transferred to the developing roll 22 corresponding to numbers of rotation are shown in FIG. 6 when an angle between a magnetic pole N1 nearest to the developing roll 22 and each of both magnetic poles S1, S4 adjacent to that pole on the magnetic roll 21 and a magnetic force of each magnetic pole is varied. In FIG. 6, "S1", "N1" and "S4" denote the nearest pole and both magnetic poles adjacent to that pole respectively; "magnetic force", a magnetic force of each magnetic pole; "an angle from N1", an angle from the nearest pole N1 to the adjacent pole S1 or S4 in plus when clockwise and in minus when counterclockwise. The diameter of the magnetic roll is set as 16 mm; the diameter of the developing roll 22, as 16 mm; the gap between the magnetic roll 21 and the developing roll 22, as 0.8 mm; the direct current bias (Vdc1) 27*a*, as 100V; Vpp of the alternate current bias 27*b*, as 1.8 kV; the frequency, as 3.0 kHz; the duty ratio, as 30%; and the direct current bias (Vdc2) 28, as 350 V.

As a result, as shown in example 1 to 3 in the table of FIG. 6, the toner amount of the developing roll 22 per unit area is 1.4 mg/cm2 or more at the first rotation of the developing roll 22 and it does not increase at the second rotation or after. On the contrary, in comparative example 4 and 6 wherein the magnetic force of the nearest pole N1 is lower than those of the both adjacent poles S1, S4 but the angle between N1 and S1 or S4 is 40 degrees or greater, the toner amount of the developing roll 22 is about 1.0 mg/cm2 at the first rotation of the developing roll 22, about 1.2 mg/cm2 at the second rotation and barely about 1.4 mg/cm2 at the second rotation. In comparative example S wherein the angle between N1 and S1 or S4 is 30 degrees but the magnetic force of the nearest pole N1 is higher than those of the both adjacent poles S1, S4, the toner amount of the developing roll 22 is about 1.0 mg/cm2 at the first rotation of the developing roll 22, about 1.4 mg/cm2 or more at the second rotation.

That is to say, when the angle between the magnetic pole N1 nearest to the developing roll 22 and each of both magnetic poles S1, S4 adjacent to that pole on the magnetic roll 21 is 30 degrees and the magnetic force of the nearest pole N1 is lower than or equal to those of the both adjacent poles S1, S4, the amount of toner is sufficiently supplied on the developing roll at the first rotation. However, when the angle between the nearest magnetic pole N1 and each of both magnetic poles S1, S4 adjacent to that pole is 30 degrees or greater and the magnetic force of the nearest pole N1 is higher than those of the both adjacent poles S1, S4, the amount of toner is sufficiently supplied on the developing roll unless at the second rotation or after. Hence, by setting the angle between the magnetic pole N1 nearest to the developing roll 22 and each of both magnetic poles S1, S4 adjacent to that pole on the magnetic roll 21 as 30 degrees or less and the magnetic force of the nearest pole N1 as lower than those of the both adjacent poles S1, S4, when a bias for conveying toner onto the developing roll from the magnetic roll is applied, a saturated toner layer is instantaneously formed so that the image consistency of the top end of an image does not decrease whereby an image forming apparatus having a hybrid developing apparatus which gives stable image quality for a long time.

With regard to those developing apparatuses forming magnetic brushes with stationary magnets and adjusting between the magnet poles for causing toner to jump, there are two patent publications, for example, Japanese laid open publication No. JP1994-274039 and JP1996-262874. JP1994-274039 discloses a non contact developing apparatus for two components developer material wherein an angle between front and back magnetic poles in a developing region facing to a latent image bearing body is kept at 25 to 80 degrees and a developing region is about among that angle so as to flattening the magnetic bristles of brushes against the latent image bearing body. JP1996-262874 discloses a non contact developing apparatus for two components developer material wherein the magnetic force of a conveying magnetic pole S2 which conveys developer material after developing to a developing magnetic pole N1 facing to a latent image bearing body is greater than or equal to that of the developing magnetic pole N1 so as to preventing carrier from adhering to latent images. These are proposals for improving problems of non contact developing apparatus for two components developer material, the problems being that bristles of the magnetic brushes contact the latent image bearing body and that carrier adhere to the latent image bearing body. An objective and constitution of the present invention is totally different from those of the above proposals because, according to the present invention, a comparatively broad nip of the magnetic brushes 30 is formed along the circumference of the developing roll 22.

Thus, in the second embodiment of the present invention, a latent image on the latent image bearing body is accurately developed since an independent bias is applied to each of the magnetic roll 21 and the developing roll 22 both of which have electrically conductive surfaces on them, and developing becomes maximum at the nearest region between the developing roll and the latent image bearing body, and developing comes to an end as the distance increases after that, and toner which causes fog is recovered to the developing roll. Further, by fixing a direct current voltage of the bias for developing applied to the developing roll and varying a direct current voltage of the bias for conveying applied to the magnetic roll on the condition as to whether it is the developing period or the non-developing period (no paper period) within the same polarity, exchange of toner on the developing roll can be controlled without affecting developing of a latent image on the latent image bearing body so that an image forming apparatus having a hybrid developing apparatus preventing selective developing and giving stable image quality for a long time can be provided.

As described above, since an angle between a magnetic pole N1 nearest to the developing roll 22 and each of both magnetic poles S1, S4 adjacent to that pole on the magnetic roll 21 is 30 degrees or less respectively and a magnetic force of the magnetic pole N1 nearest to the developing roll is lower than a magnetic force of each of both magnetic poles S1, S4 adjacent to that pole, a toner layer is instantaneously formed when a bias for conveying toner onto the developing roll 22 from the magnetic roll 21 is applied, so that the image consistency of the top end of an image does not decrease, which results in providing an image forming apparatus having a hybrid developing apparatus giving stable image quality for a long time.

Third Embodiment

In a third embodiment of the present invention described less, constitutions of apparatuses and restricted conditions described by and shown in FIGS. 1, 2 and 3 in the first embodiment are the same as in the second embodiment unless otherwise specifically described. The explanation done in the first embodiment is to be replaced in the second embodiment as far as FIGS. 1, 2 and 3 are concerned, though the explanation in the second embodiment is omitted. It follows therefore that the second embodiment will be described by adding and referring to FIGS. 7 to 11.

Figure 8:
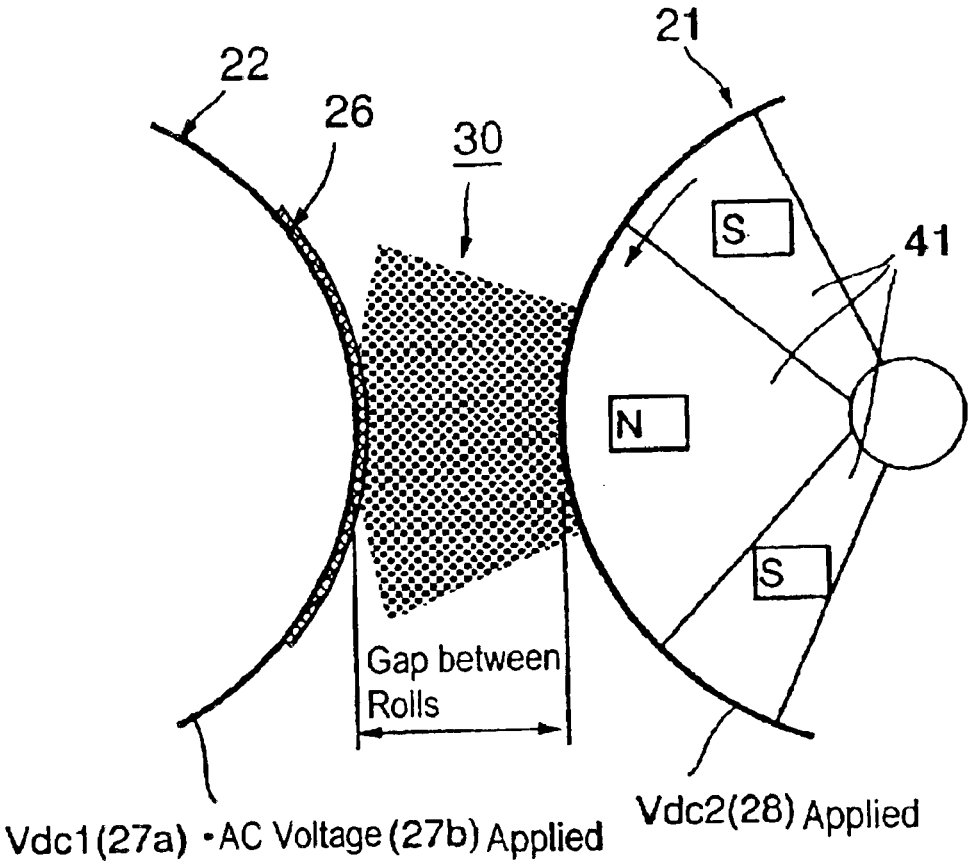
FIG. 8 is a schematic drawing illustrating a case that a toner thin layer is formed onto the developing roll from the magnetic roll.
Figure 9:
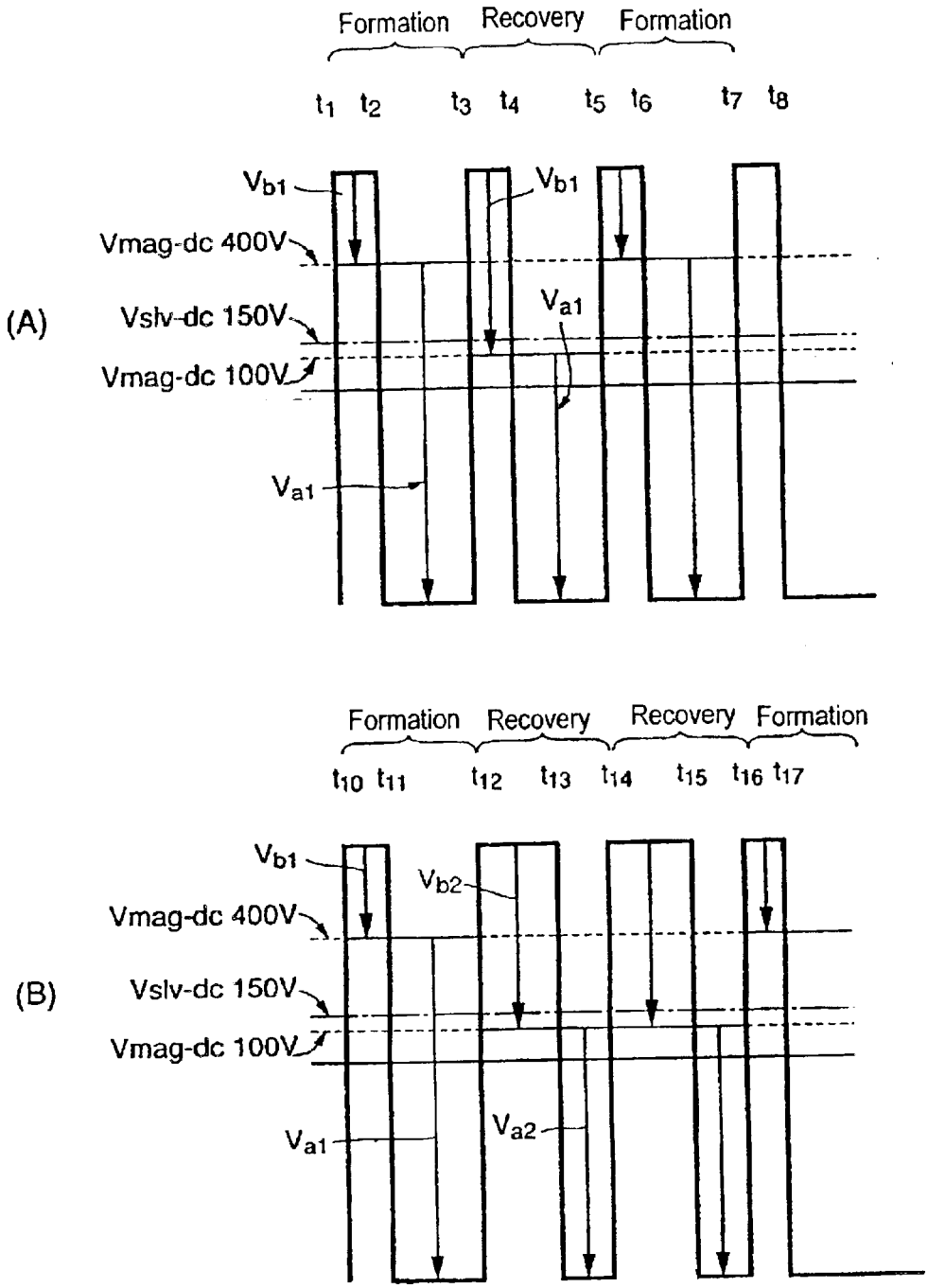
FIG. 9 is a schematic drawing illustrating a bias in case of forming a toner thin layer on the developing roll and recovering a toner thin layer to the magnetic roll.

FIG. 7 is a schematic drawing illustrating a case that a toner thin layer on the developing roll is recovered to the magnetic roll; FIG. 8 is a schematic drawing illustrating a case that a toner thin layer is formed onto the developing roll from the magnetic roll; FIG. 9 is a schematic drawing illustrating a bias in case of forming a toner thin layer on the developing roll and recovering a toner thin layer to the magnetic roll; FIG. 10 is a table showing a relationship between a number of rotations of the developing roll 22 and an amount of toner when a toner thin layer is formed; and FIG. 11 is a table showing a varied amount of toner on the developing roll 22 when the gap between the magnetic roll and the developing roll is varied.

In FIG. 7, 40 is a toner layer which is left on the developing roll after toner on the developing roll 22 is recovered. In FIGS. 7 and 8, 41 is a stationary magnet in the magnetic roll 21. In FIG. 8, 26 is atoner thin layer formed on the developing roll 122.

As mentioned above, when highly consistent developing patterns for example 50% or higher, are successively printed, fine particles of toner and contamination of toner constituents stick to the developing roll that causes toner filming so that the toner thin layer 26 on the developing roll 22 becomes uneven leading to unevenness of images such as generation of heterogeneous image consistency. Further, when highly consistent images are successively printed with a compact developing apparatus, developing property of toner on the developing roll 22 is often decreased. One reason is regarded as poor toner charge on account of selective developing of toner and the other is lack of toner amount on the developing roll 22. As a measure for poor toner charge caused by selective developing of toner, it is proposed that toner is pulled back to the magnetic roll with reverse electric field after developing. However there is a big possibility of generating heterogeneous image consistency on account of lack of toner on the developing roll when the next developing begins, which is another reason.

Hence, in order to stabilize image consistency for successive printing, when successive printing data are communicated, a toner thin layer is peeled off periodically from the developing roll for refreshing by setting interval between recovery and change of the toner layer on the developing roll 22 to the magnetic roll 21 as variable. If toner is peeled off every time when developing is over, it takes time to form again a stable toner layer so that a sufficient printing rate is not available though toner on the developing roll refreshes all the time.

In the third embodiment according to the present invention, toner 25 is charged with a predetermined charging value using carrier by a two components developing method, the charged toner 25 is made to form a thin layer 26 on the developing roll 22 as being controlled so as to become a predetermined layer thickness by a potential difference, a latent image on the latent image bearing body 3 is accurately developed with the toner 25 on the developing roll by applying a developing bias consisting of a direct current bias and an alternate current bias superposed thereon directly on the conductive sleeve of the outermost surface of the developing roll 22, and toner 25 is facilitated to move between the magnetic roll 21. These steps enable stable developing for a long time.

In case of developing successively, it is important to supply new toner 25 onto the developing roll 22 by pulling back the toner 25 on the developing roll by image data to the magnetic brushes 30 on the magnetic roll 21. However, if all the toner 25 on the developing roll is peeled off onto the magnetic roll 21 only by a direct current bias, toner 25 is deposited on the surface of the magnetic roll 21 so that it takes time to form a next toner thin layer 26, leading to lowering a printing rate. Further, if an image is formed under the state of an incomplete toner layer, uneven prints are generated at the top part of a printing.

Since a part having a developing hysteresis is different from a part having no developing hysteresis in terms of way of peeling off, if a toner thin layer 26 on the developing roll 22 is peeled off and formed only by a direct current bias, uneven developing occurs when next new developing is carried out. However, the inventor found that if direct current (DC) biases were applied on the developing roll 22 and the magnetic roll 21 and vibrational effect caused by magnetic brushes 30 and an alternate current (DC) bias was used, a toner layer existing on the base part of the developing roll 22 was peeled off while at least one toner thin layer 26 was remained on the developing roll 22 so as to erase the developing hysteresis. If a duty ratio of the alternate current (AC) is 50~70%, the toner 25 peeled off is recovered to the magnetic brushes 30 without agglomeration and mixed with newly supplied toner being replenished smoothly to the developing roll 22.

The reason why toner layer is rapidly formed if a toner layer existing on the base part of the developing roll 22 is peeled off while one toner thin layer 26 is remained on the developing roll 22 has not been clearly elucidated. It is considered that a toner thin layer 26 necessary for developing for a short time is obtained as shown in FIG. 5 because toner is instantaneously transferred on account of effective action of an electric field to form a thin layer by setting a duty ratio as 50–70% so that a residual toner layer 40 exists on the developing roll and recovered toner is not agglomerated on the surface of the magnetic roll adjusting a toner amount of the surfaces of the developing roll 22 and the magnetic roll 21 when a bias is applied between the electro-conductive magnetic roll 21 and the electro-conductive developing roll 22. When a duty ratio surpasses 70%, leak current increases causing uneven recovery or faulty action. Further, in order to rapidly transfer toner between the developing roll 22 and the magnetic roll 21, a gap between roll is less than 0.2–0.5 mm or preferably is 0.3–0.4 mm.

In the third embodiment, the direct current bias (Vdc1) 27*a* of 150 volts and the square wave alternate current bias 27*b* of Vpp of 1.5 kV, a frequency of 3.0 kHz, a duty ratio of 30% are used. Thus, a direct current bias (Vdc1) 27*a* and an alternate current bias 27*b* are applied directly to the developing roll 22 and the conductivity of the superficial surface of the developing roll 22 is $10^6$ Ω·cm$^2$ or less so that a good developing property to latent images on the latent image bearing body and a good recovery property of the toner thin layer to the magnetic roll 21 are obtained whereby stability for successive printing is improved. Further, a sharp bias can be applied at the time of developing between the developing roll 22 and the latent image bearing body, and between the developing roll 22 and the magnetic roll so that a good reactivity for forming a toner layer at the beginning of developing. Depending on an image data, a particular bias can be applied at the time of toner layer formation until the beginning of developing for adjusting formation of a toner layer.

As described above, a saturated toner amount of the toner thin layer 26 of the developing roll 22 is determined by the difference between the direct current bias (Vdc2) 28 and the direct current bias (Vdc1) 27*a*. When the direct current bias (Vdc2) 28 is set as 400 V and the direct current bias (Vdc1) 27*a*, as 150 V, a toner layer of 1.0 mg/cm2 is obtained by a rotation of two rounds. Though the adjustment of the toner layer can be carried out basically by the potential difference between the direct current bias (Vdc2) 28 and the direct current bias (Vdc1) 27*a*, factors such as a charge amount of toner and a strength of the magnetic pole of the magnetic roll 21 often contribute. Accordingly, for successive printing, a printing coefficient of a printing data is detected with a dot counter provided in a control device of the image forming apparatus and a direct current bias (Vdc2) 28 is varied in response to the printing coefficient so that a uniform image can be obtained. This process is important for preventing the scattering of toner from the developing roll. In ordinary printing, a toner amount on the developing roll is set as comparatively low so as to decrease scattering; Only when necessary such as in time of high consistent printing, a toner amount on the developing roll is adjusted so that an optimum toner layer can be formed on the developing roll at the beginning of developing. Further, a little high potential difference between the direct current bias (Vdc2) 28 and the direct current bias (Vdc1) 27*a* is advantageous.

FIG. 9 is a schematic drawing illustrating a direct current bias ($V_{dc1}$) 27*a*, an alternating bias 27*b* and a direct current bias ($V_{dc2}$) 28 in case of forming a toner thin layer 26 on the developing roll 22 and recovering toner 25 to the magnetic roll 21. FIG. 9(A) is a drawing illustrating a case in which a duty ratio of the alternating bias 27*b* for forming a toner thin layer and for recovering toner is the same. FIG. 9(B) is a drawing illustrating a case in which a duty ratio of the alternating bias 27*b* for recovering toner is varied from that for forming a toner thin layer. In FIG. 9, $V_{slv}$ denotes a voltage level applied to the developing roll 22 and $V_{mag}$, a voltage level applied to the magnetic roll 21. When a toner thin layer 26 is formed on the developing roll 22, $V_{mag}$ is set as 400 V; when toner 25 is recovered from the developing roll 22, $V_{mag}$ is set as 100 V; $V_{slv}$ is, as described above, set as 150 V. An alternate current bias 27*b* consisting of a square wave has Vpp of 1.5 kV, a frequency of 3.0 kHz and a duty ratio of 30%.

Just for reference, operation between preceding t and succeeding t of FIG. 9*a* will be explained hereunder.

During time $t_1$–$t_2$, toner is drawn back from the developing roll 22 to the magnetic roll 21 by voltage $Vb_1$.

During time $t_2$–$t_3$, toner is moved from the magnetic roll 21 toward the developing roll 22 by voltage $Va_1$.

During time $t_3$–$t_4$, toner is recovered from the developing roll 22 to the magnetic roll 21 by $Vb_1$.

During time $t_4$–$t_5$, as the voltage applied to the magnetic roll 21 is 100V, toner recovering is weak and slowed by potential difference of Vslv (150V)−Vmag(100V)=50V.

During time $t_5$–$t_6$, toner is drawn back from the developing roll 22 toward the magnetic roll 21 by $Vb_1$.

During time $t_6$–$t_7$, toner is removed from the magnetic roll 21 toward the developing roll 22 by $Va_1$.

During time $t_7$–$t_8$, toner is recovered from the developing roll 21 to the magnetic roll 21 by $Vb_1$.

As shown in FIG. 9(A), in case a duty ratio is the same when a toner thin layer is formed on the developing roll 22 and when recovered, voltage ($V_{mag}$) of 400 V is applied to the magnetic roll 21 at $t_1$, which is a time when a toner thin layer 26 is formed on the developing roll 22. Therefore, with an alternate current bias 27*b* applied to the developing roll 22 and $V_{mag}$ of a direct current bias ($V_{dc2}$) 28, a toner thin layer 26 on the developing roll is recovered at the time $t_1$ by a potential difference $V_{b1}$ which causes transferring of toner from the developing roll 22 to the magnetic roll 21. Then, a toner thin layer 26 is formed on the developing roll at the time $t_2$ by a potential difference $V_{a1}$ which causes transferring of toner from the magnetic roll 21 to the developing roll 22. Action the same as that at $t_2$ occurs at $t_6$. That is, a toner layer is formed on the developing roll 22 by electric potential difference $V_{a1}$ which allows toner to be moved from the magnetic roll 21 toward the developing roll 22.

In case developing is finished after that and toner is recovered on the developing roll 22, $V_{mag}$ of 100 V is applied to the magnetic roll 21 at $t_3$. Consequently, a potential difference consisting of a square wave of a duty ratio of 30% and $V_{mag}$ applied to the magnetic roll 21 is 300 V larger than $V_{b1}$ at the time $t_1$ which causes transferring of toner from the developing roll 22 to the magnetic roll 21. Action the same as that at $t_3$ occurs at $t_7$. That is, voltage Vmag applied to the magnetic roll is set to 100V, and toner is recovered to the magnetic roll 21 from the developing roll 22. On the contrary, a potential difference $V_{a1}$ which causes transferring of toner from the magnetic roll 21 to the developing roll 22 becomes 300 V smaller. Therefore, though a toner thin layer 26 on the developing roll 22 is recovered onto the magnetic roll 21, the toner thin layer once formed on developing roll is not completely recovered to the magnetic roll with $V_{mag}$ of a potential difference of 100 V applied to the magnetic roll 21 and $V_{slv}$ of a potential difference of 150 V applied to the developing roll 22.

In this state, toner is deposited on the magnetic roll 21 by transfer of toner 25 on the magnetic brushes 30 of the magnetic roll 21 so that the surface resistance of the magnetic roll 21 increases. Even if a potential of Vmax, that is 400 V, which forms a toner thin layer 26 on the developing roll 22 is again applied at the time $t_5$ without change, the surface of the developing roll 22 is hard to be instantaneously energized by the applied voltage so that formation of a thin layer is retarded particularly at the first round of rotation of developing roll 22.

When Vmag is set to 100V at $t_3$, electric potential difference $Va_1$ acts to form toner layer on the developing roll 22 and electric potential difference $Vb_1$ acts to draw back the toner toward the magnetic roll 21 compete against each other at $t_4$. Accordingly, the toner on the developing roll 22 is drawn back toward the magnetic roll 21 and at the same time toner is supplied, and the toner layer 26 on the developing roll 22 falls in a state completely unmoved. Action the same as that at $t_4$ occurs at $t_8$. That is, a state occurs in which toner is drawn back the magnetic roll 21 in the state electric potential difference $Va_1$ competes against that of $Vb_1$.

However, as shown in FIG. 9(B), after a toner thin layer is formed on the developing roll 22 during a period from $t_{10}$ to $t_{12}$, toner is recovered during a period from $t_{12}$ to $t_{16}$ with an alternate current bias 27*b* having a changed duty ratio of 50–70%. Thus, a little toner is remained on the developing roll 22 with a potential difference between a voltage Vslv of 150 applied to the developing roll 22 and a voltage Vmag of 100 applied to the magnetic roll 22 and a constituent for transferring toner from the magnetic roll 21 to the developing roll 22 is increased with an alternate current constituent of $V_{a2}$, shown in FIG. 9(B), so as to obtain an effect of not depositing toner on the surface of the developing roll 21.

An appropriate duty ratio of an alternate current bias 27*b* for forming a toner thin layer 26 is a little different from that for recovering toner depending on a strength for fastening of bristles of the magnetic brushes by a magnetic force of the magnetic roll 21 (bristles by a magnetic force of a magnetic field and a magnetic force of carrier). Hence, as toner transferred more easily between the surface of the magnetic roll 21 and the magnetic brushes 30, more effective toner transfer is carried out if a duty ratio of an alternate current bias 27*b* for recovery is smaller than that for forming.

Results confirmed by experiments are shown in the table of FIG. 10. The table of FIG. 10 shows the measured results of toner amounts at the time of formation of a toner thin layer and rotational numbers of rotation of the developing roll 22. Comparative example 1 and 2 are the cases in which all toner is recovered without remained (Comparative example 1) and toner is recovered with a little toner remained (Comparative example 1) where a duty ratio of the alternating bias 27*b* is 30% in both cases. Comparative example 2, 3 and example 1, 2 are results obtained under the condition that a duty ratio of the alternating bias 27*b* for recovery is varied from 30 to 70% with a little toner 25 on the developing roll 22. Numerals in the table in FIG. 10 are values of toner amount (mg/cm) on the developing roll 22. Zero round denote a state in which a layer has been formed before and toner is recovered once.

As shown in FIG. 10, when toner is remained on the developing roll 22 after recovery, developing property is rapid because an amount of toner is abundant at the first round of rotation. As shown in example 1 or 2, when a duty ratio of the alternating bias 27*b* is 50% or greater, an amount of toner at the first to the second round of rotation of the developing roll is greater than that in comparative example 2 or 3 where a duty ratio of the alternating bias 27*b* is 30 or 40%, which indicates that toner is instantaneously transferred. Evaluating images by an experimental apparatus, the difference of consistency between a top part and other parts of a half tone image on a full page of A4 paper is scarcely observed with a duty ratio of 50% and 70% compared with 30 and 40%.

The table of FIG. 11 shows measured results of a shifting relation of an amount of toner on the developing roll 22 to a gap between the magnetic roll 21 and developing roll 22 varying from 0.2 to 0.5 mm. As a condition for measurement, toner is a little remained on the developing roll and a duty ratio for recovery is 50%.

As it can be seen with the result, the narrower is the gap between the magnetic roll 21 and the developing roll 22, the more easily can be obtained an effect of electric field. However, a gap of 0.5 mm in example 6 is a critical condition for an unremarkable mottle of image consistency on the top end of an image. Therefore, a gap of preferably 0.4 mm is considered to be an acceptable limit. With a gap of 0.2 or under, as is the case in example 3, a flow of the magnetic brushes needs to be adjusted by narrowing the gap between the doctor blade 29 and the magnetic roll 21, which is difficult to adjust, so that a gap of 0.3 or broader is preferable.

In the present embodiment, when an unshown control circuit of the image forming apparatus receives a printing data, a dot counter provided to an unshown control device of the image forming apparatus detects a data amount of each image, a toner thin layer 26 is periodically peeled off from the developing roll 22 at an interval in response to a printing coefficient determined by passed sheets of paper and an amount of data for recovery and exchange of toner layer on the developing roll 22 to refresh. This refresh is carried out between sheets of paper after developing (i.e., during paper is conveyed) by varying the direct current bias (Vdc2) 28 and setting a duty ratio of the alternating current bias as 50–70% or after printing (i.e., after paper is conveyed). On the occasion of the exchange of toner, in order to keep a good printing rate, a time for recovering and replenishing a toner layer on the developing roll 22 during a predetermined period may be adjusted by adjusting a distance between sheets of paper.

Voltage values of the DC bias ($V_{dc1}$) 27*a*, the AC bias 27*b* or the DC bias 28, $V_{pp}$ or the frequency that has been explained above are for examples and are obviously variable depending on situation.

Fourth Embodiment

In a fourth embodiment of the present invention described less, constitutions of apparatuses and restricted conditions described by and shown in FIGS. 1, 2 and 3 in the first embodiment are the same as in the second embodiment unless otherwise specifically described. The explanation done in the first embodiment is to be replaced in the second embodiment as far as FIGS. 1, 2 and 3 are concerned, though the explanation in the second embodiment is omitted. It follows therefore that the second embodiment will be described by adding and referring to FIGS. 12 to 15.

FIGS. 12 and 13 are tables showing ghost performances and image consistencies at various numbers of printing sheets respectively and toner particle sizes after 10000 sheets printing according to varied positive duty ratios in case a direct current bias after developing (between paper sheets) is varied (FIG. 12) or not varied (FIG. 13) from the bias during developing; FIG. 14 is a table showing a relation between a particle size distribution and a property of maintaining image consistency, and variation of toner particle size with respect to a number of printing sheets; and FIG. 15 is a table showing various properties such as ghost, toner scattering or performance for following solid images corresponding to various values of toner layer thickness.

In a fourth embodiment according to the present invention, a voltage value of the direct current bias ($V_{dc2}$) 28 on the magnetic roll 21 is kept greater than a voltage value of the direct current bias ($V_{dc1}$) 27*a* on the developing roll 22 at the state that the alternate current bias 27*b* is applied to the developing roll after developing while the direct current bias ($V_{dc2}$) 28 or both of the direct current bias ($V_{dc1}$) 27*a* and the direct current bias ($V_{dc2}$) 28 so as to remain a part of toner on the developing roll between sheets or data in case printing data are continuous and to recover all of toner 25 in case printing is completely finished. Thus, a bias corresponding to developing states with regard to the developing roll and the magnetic roll can be applied without a complicated structure such as an auxiliary electrode or buried electrodes in the developing roll. Further, since a part of toner is remained at the beginning of developing in case of continuous printing data, a toner thin layer is rapidly formed compared with the case all of toner is recovered. Therefore, a method for recovery of toner in an image forming apparatus wherein fog is prevented while a printing rate is not affected by exchange of toner and a stable image is obtained for a long time can be provided.

The above is an action of an image forming apparatus having a developing apparatus of the fourth embodiment of the present invention. Referring to FIG. 4 to FIG. 15, the following observed results are described; a relation of a conductivity of the sleeve of the developing roll to conservation of consistency (FIG. 4); a relation of a positive duty ratio of the alternate current bias 27*b* to developing ghost or image consistency in case the direct current bias (Vdc2) 28 applied to the magnetic roll is varied (FIG. 12) or not varied (FIG. 13); a relation of a particle size distribution of toner to conservation of consistency and change of a particle size of toner with printing sheets number (FIG. 14); and a relation of a thickness of the toner thin layer 26 on the developing roll to states of ghost, scattering or performance for following solid images.

First, FIG. 4 is a table showing a relationship between a volume resistivity of a sleeve on a developing roll and maintaining property of an image consistency. The variation of image consistency (initial 1.43) after printing 10,000 sheets is investigated. A DC bias ($V_{dc1}$) 27*a* applied to the developing roll 22 is 100 V; A $V_{pp}$, a frequency and a duty ratio of the AC bias are 1.5 kV, 3.0 kHz and 30% respectively, and a DC bias ($V_{dc2}$) 28 is 350V. As a result: if a volume resistivity of the sleeve material is $10^7$ Ω·cm$^3$ or greater, image consistency after printing 10,000 sheets decreases extremely; and if it is $10^6$ Ω·cm$^3$ or less, there is almost no problem with regard to image consistency.

FIG. 12 and FIG. 13 show the relation of ghost to a positive duty ratio of the alternating bias 27*b* with in the range from 20% to 70% and an image consistency after 5000 sheets printing and 10,000 sheets printing under the condition that a number average particle size of toner is 7.51 and a variance is 1.23. In FIG. 12, a voltage value of the direct current bias applied on the magnetic roll 21 is varied; in FIG. 13, the voltage value is not varied. A level of ghost is denoted by ○, Δ and X which represent a case in which a ghost part is not observed, a case in which a ghost part is observed a little and a case in which ghost is clearly observed.

As shown in FIG. 12, when a voltage value of the direct current ($V_{dc2}$) bias applied on the magnetic roll 21 is varied after developing (between sheets), ghost is not observed under the condition of a duty ratio of 50% or less, an image consistency is good under the condition of a duty ratio of 40% or less and a toner particle size is good under the condition of a duty ratio of 50% or less. On the contrary, as shown in FIG. 13, when a voltage value of the direct current ($V_{dc2}$) 28 bias applied on the magnetic roll 21 is not varied after developing (between sheets), though ghost is not observed under the condition of a duty ratio of 50% or less as well as when the direct current ($V_{dc2}$) bias is not varied as shown in FIG. 12, image consistency and toner particle size are apparently decreased even if a duty ratio is 20%. Therefore, a good result is obtained when a voltage value of the direct current bias ($V_{dc2}$) 28 is varied and a positive duty ratio of the alternate current bias 27*b* is 50% or less, or preferably 40% or less.

FIG. 14 shows a relation between a toner particle size distribution and conservation of consistency and a change of toner particle size regarding a number of printing sheets. When a distribution (a volume particle size distribution/a number particle size distribution) is varied from 1.4 to 1.1, a change of image consistency for 5000 sheets printing and for 10000 sheets printing and a change of toner particle size under each particle size distribution also for 5000 sheets printing and for 10000 sheets printing are observed. Image consistency decreases significantly and toner particle size variance varies apparently when the distribution is 1.3 or greater. It follows, therefore, that toner particle size variance is preferably less than 1.3.

FIG. 15 shows a relation of a thickness of the toner thin layer within the range from 0.4 to 2.0 to ghost, scattering and performance for following solid images. ○, Δ and X represent a case in which all items are good, a case in which they are observed slightly and a case in which all items are bad respectively. As shown by FIG. 15, if the thickness of the toner layer is too thin, such as 0.4 mg/cm$^2$, the performance image consistency becomes deteriorate when high consistent printing data is continuously transmitted, and when the thickness of the toner layer exceeds 1.7 mg/cm$^2$ which is too thick, developing ghost or toner scattering tend to be generated. Therefore, the thickness of toner thin layer 26(mg/cm$^2$) ranges from 0.5 to 1.7 mg/cm$^2$ preferably.

Putting the above descriptions together, if a volume resistivity of the sleeve on the developing roll 22 is $10^6$ Ω·cm$^3$ or less, image is formed with an appropriate consistency. If a voltage value of the direct current ($V_{dc2}$) 28 bias applied on the magnetic roll 21 is varied after developing (between sheets) and a positive duty ratio of the alternating current bias 27*b* is 50% or less or preferably 40% or less, a performance concerning ghost, image consistency and toner particle size becomes good. With regard to relation between toner particle distribution and conservation of consistency, it is preferable that a toner particle distribution is less than 1.3 and a thickness of the toner thin layer 26 on the developing roll 22 is within the range from 0.5 to 1.7 mg/cm$^2$.

Voltage values of the DC bias ($V_{dc1}$) 27*a*, the AC bias 27*b* or the DC bias ($V_{dc2}$) 28, $V_{pp}$ or the frequency that has been explained above are for examples and are obviously variable depending on situation.

What is claimed is:

1. An image forming apparatus having a hybrid developing apparatus comprising a magnetic roll of two components developer material, which electrostatically charges developer material consisting of carrier and toner magnetically held thereon, and a developing roll, which forms an only toner thin layer on its surface by transferring the toner from the magnetic roll wherein latent images on a latent image bearing body are developed with the toner by applying developing bias to nearest approached regions (developing regions) between the developing roll and the latent image bearing body, characterized in that a developing roll, which is electrically conductive at least on its surface, is directly confronted with a latent image bearing body through an insulative toner thin layer, and that a developing bias is applied to the electrically conductive surface of the developing roll, forming a continuous plane of electrode, and the entire developing roll is electrically conductive and an alternating current bias superposed by a direct current bias thereon is applied onto the developing roll to draw back toner from the latent image carrying body to the developing roll, and wherein a duty ratio of the alternating current bias is set as within the range from 10 to 50%.

2. An image forming apparatus having a hybrid developing apparatus comprising a magnetic roll of two components developer material, which electrostatically charges developer material consisting of carrier and toner magnetically held thereon, and a developing roll, which forms an only toner thin layer on its surface by transferring the toner from the magnetic roll utilizing a bias for transferring and magnetic brushes of the magnetic roll wherein latent images on a latent image bearing body are developed with the toner by applying developing bias to nearest approached regions (developing regions) between the developing roll and the latent image bearing body, characterized in that both of the magnetic roll and the developing roll are electrically conductive at least on their surfaces, and that an independent bias is applied to each of the two rolls, wherein a bias for conveying applied to the magnetic roll is a direct current bias and a bias for developing applied to the developing roll is a bias consisting of a direct current bias and an alternate current bias superposed thereon, and wherein a direct current voltage of the bias for developing applied to the developing roll is fixed and a direct current voltage of the bias for conveying applied to the magnetic roll is varied on the condition as to whether it is a developing period or a non-developing period (no paper period) within the same polarity.

3. An image forming apparatus having a hybrid developing apparatus comprising a magnetic roll of two components developer material, which electrostatically charges developer material consisting of carrier and toner magnetically held thereon, and a developing roll, which forms an only toner thin layer on its surface by transferring the toner from the magnetic roll utilizing a bias for transferring and magnetic brushes of the magnetic roll wherein latent images on a latent image bearing body are developed with the toner by applying developing bias to nearest approached regions (developing regions) between the developing roll and the latent image bearing body, characterized in that both of the magnetic roll and the developing roll are electrically conductive at least on their surfaces, and that an independent bias is applied to each of the two rolls, wherein an angle between a magnetic pole on the magnetic roll nearest to the developing roll and each of both magnetic poles adjacent to that pole on the magnetic roll is 30 degrees or less respectively, and wherein an intensity of magnetic force of the magnetic pole nearest to the developing roll on the magnetic roll is lower than an intensity of magnetic force of each of the both magnetic poles adjacent to that pole.

4. An image forming method having a magnetic roll for transferring two-component developer material, which electrostatically charges developer material consisting of carrier and toner magnetically held thereon, and a developing roll, which forms a thin layer of toner alone on its surface by transferring the toner utilizing a bias for transferring and magnetic brushes of the magnetic roll wherein latent images on a latent image bearing body are developed with the toner by applying developing bias to nearest approached regions (developing regions) between the developing roll and the latent image bearing body, characterized in that a direct current bias is applied to the magnetic roll and a bias consisting of a direct current bias and an alternate current bias superposed thereon to the developing roll, and that sources of the direct current biases are independent from each other while a voltage of one of the direct current biases and a duty ratio of the alternate current bias are varied so as to refresh (recover and exchange) toner on the developing roll.

5. An image forming method according to claim 4, wherein a duty ratio of the alternate current bias is from 50% to 70%.

6. An image forming method according to claim 4, wherein a gap between the developing roll and the magnetic roll is within the range of from 0.2 mm to 0.5 mm and a rotational direction of the developing roll is the same as the magnetic roll.

7. An image forming method according to claim 4, wherein a period when developing is ceased for refreshing (recovering and exchanging) toner is a period between printing paper sheets (during a succession of paper sheets is being transported) and/or a period after printing (after a succession of paper sheets has been transported).

8. An image forming method having a magnetic roll for transferring two-component developer material, which electrostatically charges developer material consisting of carrier and toner magnetically held thereon, and a developing roll, which forms a thin layer of toner alone on its surface by transferring the toner utilizing a bias for transferring and magnetic brushes of the magnetic roll wherein latent images on a latent image bearing body are developed with the toner by applying developing bias to nearest approached regions (developing regions) between the developing roll and the latent image bearing body, characterized in that a direct current bias is applied to the magnetic roll and a bias consisting of a direct current bias and an alternate current bias superposed thereon to the developing roll, and that sources of the direct current biases are independent from each other while, by varying one of the direct current biases, a part of toner on the developing roll is recovered during a period between printing paper sheets or printing data when the printing data is continuous and all the toner is recovered when the printing is completed.

9. An image forming method according to claim 8, wherein a duty ratio of the alternate current bias is set as within the range from 10 to 50%.

10. An image forming method according to claim 8, further comprising making up the surface of the developing roll with an approximately uniform electro conductive sleeve having a conductivity of $10^6$ $\Omega\cdot cm^3$ or less, and making an applied bias consisting of a direct current bias and an alternate current bias superposed thereon act between the developing roll and the electrosttatic latent image bearing body, and between the developing roll and the magnetic roll.

11. An image forming method according to claim 8, further comprising making a ratio of a volume average particle size to a number average particle size of the toner which the developer material contains 1.25 or less and controlling an average particle size of the carrier 50 $\mu$m or less.

12. An image forming method according to claim 8, further comprising controlling an amount of charge of the toner which the developer material contains within the range of from 5 to 20 $\mu$C/g.

13. An image forming method according to claim 8, further comprising controlling a toner thickness to 50 $\mu$m or less and a toner amount within range of from 0.5 to 1.7 $mg/cm^2$.

14. An image forming method having a magnetic roll for transferring two-component developer material, which electrostatically charges developer material consisting of carrier and toner magnetically held thereon, and a developing roll, which forms a thin layer of toner alone on its surface by transferring the toner utilizing a bias for transferring and magnetic brushes of the magnetic roll wherein latent images on a latent image bearing body are developed with the toner by applying developing bias to nearest approached regions (developing regions) between the developing roll and the latent image bearing body, characterized in that a direct current bias is applied to the magnetic roll and a bias consisting of a direct current bias and an alternate current bias superposed thereon to the developing roll, that sources of the direct current biases are independent from each other, and that, by varying one or both of the direct current biases while a voltage value of the bias on the magnetic roll is maintained higher than a voltage value of the bias on the developing roll, toner on the developing roll is recovered so that a part of toner remains on the developing roll after developing.

15. An image forming method according to claim 14, wherein a duty ratio of the alternate current bias is set as within the range from 10 to 50%.

16. An image forming method according to claim 14, further comprising making up the surface of the developing roll with an approximately uniform electro conductive sleeve having a conductivity of $10^6$ $\Omega \cdot cm^3$ or less, and making an applied bias consisting of a direct current bias and an alternate current bias superposed thereon act between the developing roll and the electrosttatic latent image bearing body, and between the developing roll and the magnetic roll.

17. An image forming method according to claim 14, further comprising making a ratio of a volume average particle size to a number average particle size of the toner which the developer material contains 1.25 or less and controlling an average particle size of the carrier 50 $\mu$m or less.

18. An image forming method according to claim 14, further comprising controlling an amount of charge of the toner which the developer material contains within the range of from 5 to 20 $\mu$C/g.

19. An image forming method according to claim 14, further comprising controlling a toner thickness to 50 $\mu$m or less and a toner amount within range of from 0.5 to 1.7 $mg/cm^2$.

* * * * *